US010006262B2

(12) United States Patent
Bansal et al.

(10) Patent No.: US 10,006,262 B2
(45) Date of Patent: Jun. 26, 2018

(54) CONTINUOUS FLOW SYSTEM FOR DRILLING OIL AND GAS WELLS

(71) Applicant: Weatherford Technology Holdings, LLC, Houston, TX (US)

(72) Inventors: Ram K. Bansal, Houston, TX (US); Geoff George, Magnolia, TX (US); Gerald Wes Don Buchanan, Calgary (CA); Justin Cunningham, Houston, TX (US); Eisenhower De Leon, Houston, TX (US); Joe Noske, Houston, TX (US); Lev Ring, Bellaire, TX (US); Jerlib J. Leal, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 502 days.

(21) Appl. No.: 14/617,270

(22) Filed: Feb. 9, 2015

(65) Prior Publication Data

US 2015/0240582 A1 Aug. 27, 2015

Related U.S. Application Data

(60) Provisional application No. 61/942,938, filed on Feb. 21, 2014.

(51) Int. Cl.
*E21B 21/10* (2006.01)
*E21B 19/16* (2006.01)
(Continued)

(52) U.S. Cl.
CPC ..... *E21B 21/106* (2013.01); *E21B 3/00* (2013.01); *E21B 19/16* (2013.01); *E21B 21/06* (2013.01);
(Continued)

(58) Field of Classification Search
CPC ..... E21B 3/00; E21B 21/106; E21B 19/16; E21B 19/165; E21B 2034/002;
(Continued)

(56) References Cited

U.S. PATENT DOCUMENTS 916,268 A 3/1909 Cameron
1,491,986 A 4/1924 Greene
(Continued)

FOREIGN PATENT DOCUMENTS

EP 0116443 A1 8/1984
EP 0606981 A1 * 7/1994 ..... E21B 34/103
(Continued)

OTHER PUBLICATIONS

EPO Partial Search Report dated Jul. 16, 2015, for European Application No. 15154968.0.
(Continued)

*Primary Examiner* — Jennifer H Gay
(74) *Attorney, Agent, or Firm* — Patterson & Sheridan, L.L.P.

(57) ABSTRACT

A flow sub for use with a drill string includes a tubular housing having a longitudinal bore therethrough and a flow port through a wall thereof and a ball. The ball is disposed in the housing above the flow port, has a bore therethrough, and is rotatable relative to the housing between an open position where the ball bore is aligned with the housing bore and a closed position where a wall of the ball blocks the housing bore. The flow sub further includes a seat disposed in the housing above the ball for sealing against the ball wall in the closed position and a sleeve disposed in the housing and movable between an open position where the flow port is exposed to the housing bore and a closed position where a wall of the sleeve is disposed between the flow port and the housing bore.

28 Claims, 27 Drawing Sheets

(51) Int. Cl.
*E21B 21/06* (2006.01)
*E21B 3/00* (2006.01)
*E21B 34/14* (2006.01)
*E21B 34/00* (2006.01)

(52) U.S. Cl.
CPC ..... *E21B 34/14* (2013.01); *E21B 2034/007* (2013.01)

(58) Field of Classification Search
CPC .... E21B 2034/007; E21B 34/08; E21B 34/14; E21B 23/006
See application file for complete search history.

(56) References Cited

U.S. PATENT DOCUMENTS 2,102,555 A 12/1937 Dyer
2,158,356 A 5/1939 Dyer
2,202,192 A 5/1940 Cypher
2,224,657 A 12/1940 Rodgers
2,239,586 A 4/1941 Appleby
2,858,838 A 11/1958 Scaramucci
2,974,922 A 3/1961 Keitahn
3,036,590 A 5/1962 Knox
3,123,157 A 3/1964 Graham
3,268,017 A 8/1966 Yarbrough
3,298,385 A 1/1967 Jackson et al.
3,497,020 A 2/1970 Kammerer, Jr. et al.
3,559,739 A 2/1971 Hutchison
3,684,318 A 8/1972 Eckert et al.
3,877,529 A * 4/1975 Litchfield ..... E21B 19/20 166/380
4,262,693 A * 4/1981 Giebeler ..... E21B 21/106 137/494
4,310,050 A 1/1982 Bourgoyne, Jr.
4,315,553 A 2/1982 Stallings
4,377,179 A * 3/1983 Giebeler ..... E21B 21/10 137/494
4,393,940 A 7/1983 Cooper et al.
4,448,267 A 5/1984 Crawford, III et al.
4,478,244 A 10/1984 Garrett
4,566,478 A 1/1986 Deaton
4,566,494 A 1/1986 Roche
5,159,981 A 11/1992 Le
5,482,119 A * 1/1996 Manke ..... E21B 23/006 166/321
5,529,126 A 6/1996 Edwards
5,551,665 A 9/1996 Noack et al.
5,558,121 A 9/1996 Webster et al.
5,896,924 A 4/1999 Carmody et al.
5,988,220 A 11/1999 Sakaki
6,119,772 A 9/2000 Pruet
6,230,824 B1 5/2001 Peterman et al.
6,253,861 B1 7/2001 Carmichael et al.
6,315,051 B1 11/2001 Ayling
6,607,042 B2 8/2003 Hoyer et al.
6,622,791 B2 9/2003 Kelley et al.
6,668,684 B2 12/2003 Allen et al.
6,739,397 B2 5/2004 Ayling
7,028,585 B2 4/2006 Pietras et al.
7,028,586 B2 4/2006 Robichaux et al.
7,108,080 B2 9/2006 Tessari et al.
7,140,455 B2 11/2006 Walter et al.
7,163,064 B2 1/2007 Moncus et al.
7,219,722 B2 5/2007 Fincher et al.
7,308,952 B2 12/2007 Strazhgorodskiy
7,726,418 B2 6/2010 Ayling
7,758,019 B2 7/2010 Braddick
7,963,339 B2 6/2011 Cowie et al.
8,016,033 B2 * 9/2011 Iblings ..... E21B 19/16 166/192
8,210,266 B2 7/2012 Younger et al.
8,403,293 B2 3/2013 Cowie et al.
8,505,635 B2 8/2013 Vatne
9,316,071 B2 * 4/2016 Feasey ..... E21B 21/08
2004/0003490 A1 1/2004 Shahin et al.
2004/0020654 A1 2/2004 Milberger et al.
2004/0154835 A1 8/2004 Allen et al.
2004/0163809 A1 * 8/2004 Mayeu ..... E21B 34/06 166/255.1
2006/0254822 A1 11/2006 Ayling
2006/0272825 A1 * 12/2006 Royer ..... E21B 34/14 166/373
2006/0278434 A1 12/2006 Calderoni et al.
2009/0025930 A1 1/2009 Iblings et al.
2009/0205838 A1 * 8/2009 Springett ..... E21B 21/01 166/380
2009/0242817 A1 10/2009 Strazhgorodskiy
2009/0272580 A1 11/2009 Dolman et al.
2010/0084142 A1 4/2010 Calderoni et al.
2010/0096190 A1 4/2010 Younger et al.
2010/0155143 A1 * 6/2010 Braddick ..... E21B 19/16 175/218
2010/0200299 A1 * 8/2010 Vatne ..... E21B 19/16 175/57
2010/0252272 A1 * 10/2010 Haughom ..... E21B 21/106 166/373
2010/0276153 A1 * 11/2010 Gette ..... E21B 33/04 166/351
2010/0300543 A1 12/2010 Braddick
2011/0155379 A1 * 6/2011 Bailey ..... E21B 19/16 166/324
2011/0203670 A1 * 8/2011 Braddick ..... E21B 21/106 137/1
2011/0308860 A1 * 12/2011 deBoer ..... E21B 17/00 175/57
2012/0018229 A1 1/2012 Leuchtenberg et al.
2013/0068532 A1 * 3/2013 Bansal ..... E21B 21/10 175/218
2013/0112428 A1 5/2013 Weir et al.
2013/0118758 A1 5/2013 Caminari
2013/0269951 A1 * 10/2013 Tahoun ..... E21B 34/06 166/373
2014/0124195 A1 * 5/2014 Tahoun ..... E21B 21/103 166/250.01
2014/0158433 A1 * 6/2014 Bisset ..... E21B 21/103 175/218
2014/0166364 A1 * 6/2014 Blue ..... E21B 21/08 175/48
2014/0202767 A1 * 7/2014 Feasey ..... E21B 21/08 175/57
2015/0136396 A1 * 5/2015 Turley ..... E21B 23/10 166/285
2015/0240582 A1 * 8/2015 Bansal ..... E21B 3/00 175/57

FOREIGN PATENT DOCUMENTS

EP 0606981 A1 7/1994
EP 1331356 A2 7/2003
GB 2118998 A 11/1983
GB 2159194 A 11/1985
GB 2220963 A 1/1990
GB 2325682 A 12/1998
GB 2378199 A 2/2003
GB 2426274 A 11/2006
GB 2464216 A * 4/2010 ..... E21B 23/04
SU 979616 A1 12/1982
WO 2005/080745 A1 9/2005
WO 2009/022914 A1 2/2009
WO 2010/112933 A2 10/2010
WO 2012/085597 A2 6/2012

OTHER PUBLICATIONS

Australian Patent Examination Report dated Dec. 18, 2015, for Australian Patent Application No. 2015200783.

Cunningham et al.—A New Continuous Flow System (CFS) for Managed Pressure Drilling, paper repared for presentation at the 2014 IADC/SPE Drilling Conference and Exhibition held in Fort Worth, Texas, Mar. 4-6, 2014, IADC/SPE/-168030-MS, 7 pages.

(56) References Cited

OTHER PUBLICATIONS

"Inductive Proximity Sensors"—Genius Devils Website, posted Apr. 23, 2013, http://geniusdevils.com/2013/04/indictive-proximity-sensors/, 9 pages.
Inventors' Solutions Drilling—Production—"Continuous Flushing Drilling (CFD)," date unknown, 25 pages.
Managed Pressure Operations—"Non Stop Driller © Continuous Circulating System," date unknown, 2 pages.
Torsvoll et al.—"Continuous Circulation During Drilling Utilizing a Drillstring Integrated Valve—The Continuous Circulation Valve", IADC/SPE 98947, paper prepared for presentation at IADC/SPE Drilling Conference held in Miami, Florida, Feb. 21-23, 2006, 7 pages.
Vail et al.—"New Developments in Air-Gas Drilling and Completions", Part 1—World Oil, Nov. 1963, pp. 70-73, Part 2—World Oil, Dec. 1963, pp. 82-86.
Weatherford TorkWrench 10-100 Iron Roughneck brochure, 2008, 8 pages.
Zreik et al.—"Improving Surface Hole Foam Drilling Performance in Karstified Limestone in Papua New Guinea," 2010 IADC/SPE Asia Pac Drilling, Nov. 1-3, 2010, Ho Chi Minh City, Vietnam, 2 pages.
Canadian Office Action dated Feb. 20, 2017, for Canadian Patent Application No. 2,881,891.
Canadian Office Action dated Apr. 12, 2016, for Canadian Patent Application No. 2,881,891.

* cited by examiner

| Operation | Action | 38a | 38b | 38c | 38d | 238 | 36p | 36f |
|---|---|---|---|---|---|---|---|---|
| Drilling | Mud pumped via top drive | Open | Closed | Closed | Open | Closed | Auto | Auto |
| Install clamp | Operate band actuator | Open | Closed | Closed | Open | Closed | Auto | Auto |
| Test clamp seal | Monitor pressure | Open | Open | Closed | Closed | Open | Auto | Auto |
| Switch mud flow to clamp | Operate CFS actuator | Open | Open | Closed | Closed | Open | Auto | Auto |
| Bleed top drive | | Closed | Open | Open | Closed | Open | Auto | Auto |
| Test bore valve | Monitor pressure | Closed | Open | Closed | Closed | Open | Auto | Auto |
| Add stand to drill string | Operate top drive | Closed | Open | Open | Closed | Open | Auto | Auto |
| Pressurize added stand | | Open | Open | Closed | Closed | Open | Auto | Auto |
| Switch mud flow to top drive | Operate CFS actuator | Open | Open | Closed | Closed | Open | Auto | Auto |
| Bleed clamp | | Open | Closed | Closed | Open | Open | Auto | Auto |
| Test port valve | Monitor pressure | Open | Closed | Closed | Closed | Open | Auto | Auto |
| Remove clamp | Operate band actuator | Open | Closed | Closed | Open | Closed | Auto | Auto |
| Resume drilling | Mud pumped via top drive | Open | Closed | Closed | Open | Closed | Auto | Auto |
| Overpressure | | | | | | | Open | Auto |
| Overflow | | | | | | | Auto | Open |

FIG. 5B

| Operation | Action | 39a | 39b | 39c | 39d | 39e | 39f | 39g | 39h |
|---|---|---|---|---|---|---|---|---|---|
| Drilling | Mud pumped via top drive | Closed | Closed | Closed | Closed | Closed | Closed | Closed | Closed |
| Install clamp | Operate band actuator | Open | Closed | Closed | Open | Closed | Closed | Closed | Closed |
| Test clamp seal | Monitor pressure | Locked | Locked | Locked | Locked | Closed | Closed | Closed | Closed |
| Switch mud flow to clamp | Operate CFS actuator | Locked | Locked | Locked | Locked | Closed | Open | Closed | Open |
| Bleed top drive | | Locked | Locked | Locked | Locked | Locked | Locked | Locked | Locked |
| Test bore valve | Monitor pressure | Locked | Locked | Locked | Locked | Locked | Locked | Locked | Locked |
| Add stand to drill string | Operate top drive | Locked | Locked | Locked | Locked | Locked | Locked | Locked | Locked |
| Pressurize added stand | | Locked | Locked | Locked | Locked | Locked | Locked | Locked | Locked |
| Switch mud flow to top drive | Operate CFS actuator | Locked | Locked | Locked | Locked | Open | Closed | Open | Closed |
| Bleed clamp | | Locked | Locked | Locked | Locked | Closed | Closed | Closed | Closed |
| Test port valve | Monitor pressure | Locked | Locked | Locked | Locked | Closed | Closed | Closed | Closed |
| Remove clamp | Operate band actuator | Closed | Open | Open | Closed | Closed | Closed | Closed | Closed |
| Resume drilling | Mud pumped via top drive | Closed | Closed | Closed | Closed | Closed | Closed | Closed | Closed |

FIG. 5C

CONTINUOUS FLOW SYSTEM FOR DRILLING OIL AND GAS WELLS

BACKGROUND OF THE DISCLOSURE

Field of the Disclosure

The present disclosure generally relates to a continuous flow system for drilling oil and gas wells.

Description of the Related Art

In many drilling operations to recover hydrocarbons, a drill string made by assembling joints of drill pipe with threaded connections and having a drill bit at the bottom is rotated to move the drill bit. Typically drilling fluid, such as oil or water based mud, is circulated to and through the drill bit to lubricate and cool the bit and to facilitate the removal of cuttings from the wellbore that is being formed. The drilling fluid and cuttings returns to the surface via an annulus formed between the drill string and the wellbore. At the surface, the cuttings are removed from the drilling fluid and the drilling fluid is recycled.

As the drill bit penetrates into the earth and the wellbore is lengthened, more joints of drill pipe are added to the drill string. This involves stopping the drilling while the joints are added. The process is reversed when the drill string is removed or tripped, e.g., to replace the drill bit or to perform other wellbore operations. Interruption of drilling may mean that the circulation of the mud stops and has to be re-started when drilling resumes. This can be time consuming, can cause deleterious effects on the walls of the wellbore being drilled, and can lead to formation damage and problems in maintaining an open wellbore. Also, a particular mud weight may be chosen to provide a static head relating to the ambient pressure at the top of a drill string when it is open while joints are being added or removed. The weighting of the mud can be very expensive.

To convey drilled cuttings away from a drill bit and up and out of a wellbore being drilled, the cuttings are maintained in suspension in the drilling fluid. If the flow of fluid with cuttings suspended in it ceases, the cuttings tend to fall within the fluid. This is inhibited by using relatively viscous drilling fluid; but thicker fluids require more power to pump. Further, restarting fluid circulation following a cessation of circulation may result in the overpressuring of a formation in which the wellbore is being formed.

SUMMARY OF THE DISCLOSURE

The present disclosure generally relates to a continuous flow system for drilling oil and gas wells. In one embodiment, a flow sub for use with a drill string includes a tubular housing having a longitudinal bore therethrough and a flow port through a wall thereof and a ball. The ball is disposed in the housing above the flow port, has a bore therethrough, and is rotatable relative to the housing between an open position where the ball bore is aligned with the housing bore and a closed position where a wall of the ball blocks the housing bore. The flow sub further includes a seat disposed in the housing above the ball for sealing against the ball wall in the closed position and a sleeve disposed in the housing and movable between an open position where the flow port is exposed to the housing bore and a closed position where a wall of the sleeve is disposed between the flow port and the housing bore.

In another embodiment, a flow sub for use with a drill string includes: a tubular housing having a longitudinal bore therethrough and a flow port through a wall thereof; a cage disposed in the housing and having a port in alignment with the flow port; and a three-way ball. The three-way ball is disposed in the cage, has a bore therethrough and a side opening carved from a wall thereof, and is rotatable relative to the housing between a top injection position where the ball bore is aligned with the housing bore and a wall of the ball blocks the side port and a bypass position where the side opening is aligned with the flow port and the ball wall blocks the housing bore. The flow sub further includes: a seat disposed in the housing above the ball for sealing against the ball wall in the bypass position and a flange of the ball in the top injection position; a port seal carried by the cage adjacent to the cage port for sealing against the ball wall in the bypass position; and a pair of pivot pins connecting the ball to the housing. One of the pivot pins has a torsional profile accessible from an exterior of the housing.

In another embodiment, an iron roughneck of a continuous flow system includes: a frame; a backup tong mounted to the frame; a wrenching tong supported by the backup tong and rotatable relative thereto; a spinner mounted to the frame; and a flow sub tong. The flow sub tong includes: a body mounted to the frame; an inlet connected to the body for injecting fluid into a flow port of a flow sub and operable to seal against a surface of a housing of the flow sub adjacent to the flow port; a plurality of clamping jaws operable to engage the housing; and an automated port valve actuator connected to the body and operable to move a sleeve of the flow sub.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 5B and 5C illustrate shifting of the drilling system between the modes.

DETAILED DESCRIPTION

Figure 1A:
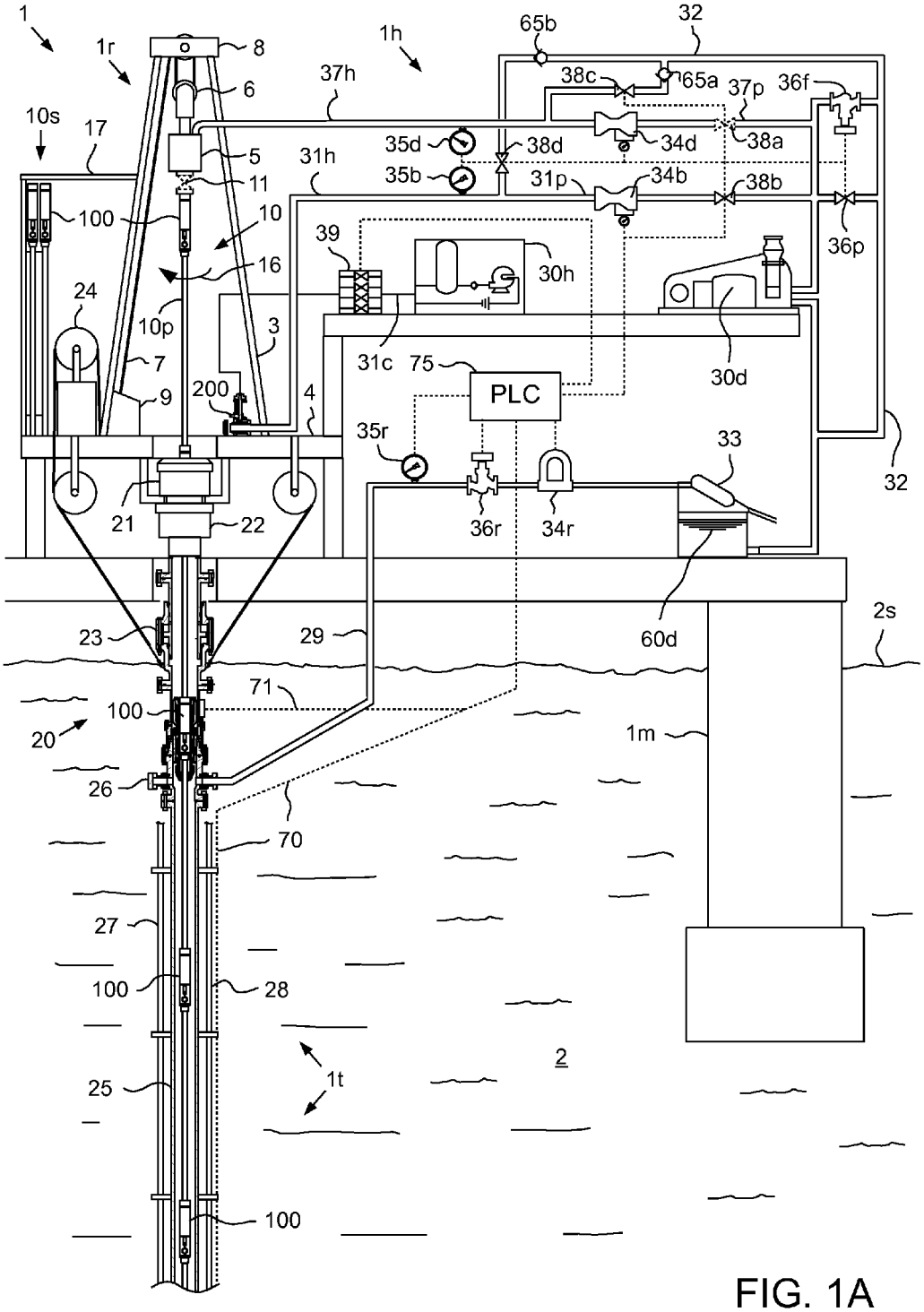
FIGS. 1A-1C illustrates a drilling system in a drilling mode, according to one embodiment of the present disclosure.
Figure 1B:
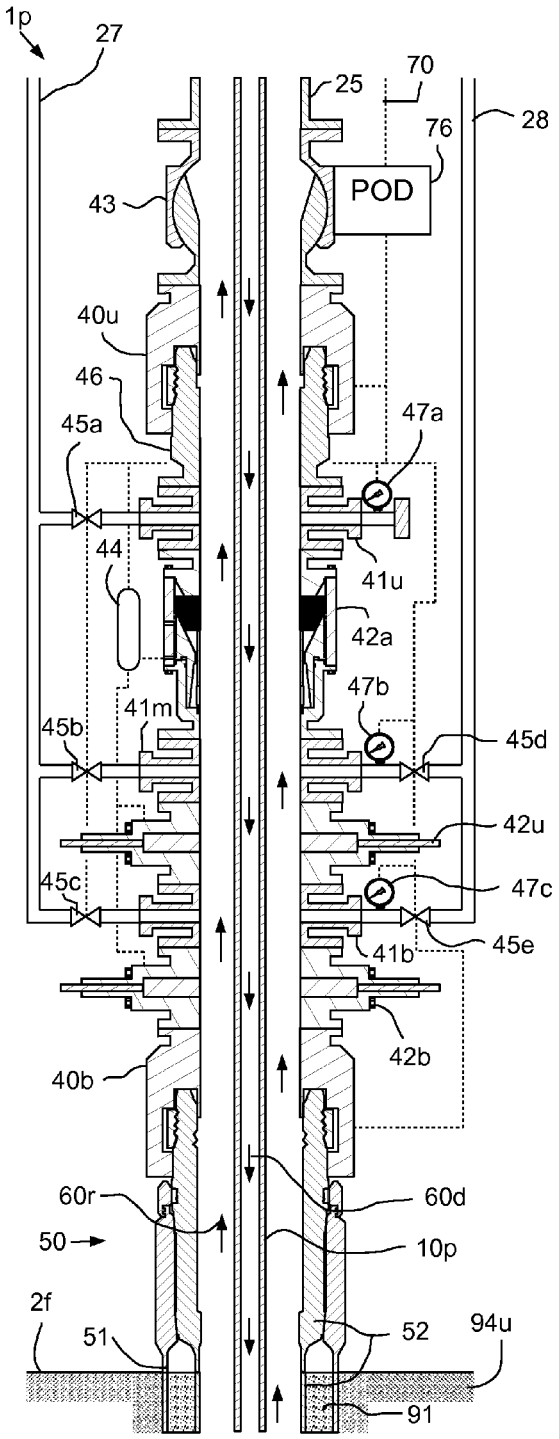
Figure 1C:
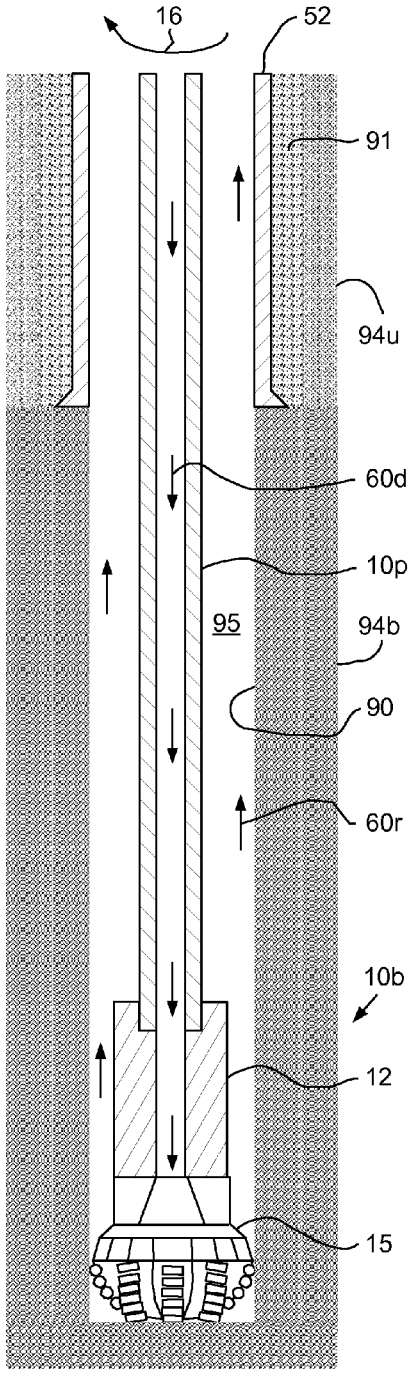

FIGS. 1A-1C illustrates a drilling system 1 in a drilling mode, according to one embodiment of the present disclosure. The drilling system 1 may include a mobile offshore drilling unit (MODU) 1*m*, such as a semi-submersible, a drilling rig 1*r*, a fluid handling system 1*h*, a fluid transport system 1*t*, and a pressure control assembly (PCA) 1*p*. The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU may be a drill ship. Alternatively, a fixed offshore drilling unit or a non-mobile floating offshore drilling unit may be used instead of the MODU 1*m*. Alternatively, the wellbore may be subsea having a wellhead located adjacent to the waterline and the drilling rig may be a located on a platform adjacent the wellhead. Alternatively, the drilling system may be used for drilling a subterranean (aka land based) wellbore and the MODU 1*m* may be omitted.

The drilling rig 1*r* may include a derrick 3 having a rig floor 4 at its lower end having an opening corresponding to the moonpool. The drilling rig 1*r* may further include a top drive 5. The top drive 5 may include a motor for rotating 16 a drill string 10. The top drive motor may be electric or hydraulic. A housing of the top drive 5 may be coupled to a rail (not shown) of the derrick 3 for preventing rotation of the top drive housing during rotation of the drill string 10 and allowing for vertical movement of the top drive with a traveling block 6. A housing of the top drive 5 may be suspended from the derrick 3 by the traveling block 6. The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. A Kelly valve 11 may be connected to a quill of a top drive 5. A top of the drill string 10 may be connected to the Kelly valve 11, such as by a threaded connection or by a gripper (not shown), such as a torque head or spear. The drilling rig 1*r* may further include a drill string compensator (not shown) to account for heave of the MODU 1*m*. The drill string compensator may be disposed between the traveling block 6 and the top drive 5 (aka hook mounted) or between the crown block 8 and the derrick 3 (aka top mounted).

The fluid transport system it may include the drill string 10, an upper marine riser package (UMRP) 20, a marine riser 25, a booster line 27, and a choke line 28. The drill string 10 may include a bottomhole assembly (BHA) 10*b*, joints of drill pipe 10*p* connected together, such as by threaded couplings (FIG. 5A), and one or more (four shown) flow subs 100. The BHA 10*b* may be connected to the drill pipe 10*p*, such as by a threaded connection, and include a drill bit 15 and one or more drill collars 12 connected thereto, such as by a threaded connection. The drill bit 15 may be rotated 16 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The PCA 1*p* may be connected to a wellhead 50 adjacently located to a floor 2*f* of the sea 2. A conductor string 51 may be driven into the seafloor 2*f*. The conductor string 51 may include a housing and joints of conductor pipe connected together, such as by threaded connections. Once the conductor string 51 has been set, a subsea wellbore 90 may be drilled into the seafloor 2*f* and a first casing string 52 may be deployed into the wellbore. The first casing string 52 may include a wellhead housing and joints of casing connected together, such as by threaded connections. The wellhead housing may land in the conductor housing during deployment of the first casing string 52. The first casing string 52 may be cemented 91 into the wellbore 90. The first casing string 52 may extend to a depth adjacent a bottom of an upper formation 94*u*. The upper formation 94*u* may be non-productive and a lower formation 94*b* may be a hydrocarbon-bearing reservoir. Alternatively, the lower formation 94*b* may be environmentally sensitive, such as an aquifer, or unstable. Although shown as vertical, the wellbore 90 may include a vertical portion and a deviated, such as horizontal, portion.

The PCA 1*p* may include a wellhead adapter 40*b*, one or more flow crosses 41*u,m,b*, one or more blow out preventers (BOPS) 42*a,u,b*, a lower marine riser package (LMRP), one or more accumulators 44, and a receiver 46. The LMRP may include a control pod 76, a flex joint 43, and a connector 40*u*. The wellhead adapter 40*b*, flow crosses 41*u,m,b*, BOPS 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPS 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 76 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 76 may be in electric, hydraulic, and/or optical communication with a programmable logic controller (PLC) 75 onboard the MODU 1*m* via an umbilical 70. The control pod 76 may include one or more control valves (not shown) in communication with the BOPS 42*a,u,b* for operation thereof. Each control valve may include an electric or hydraulic actuator in communication with the umbilical 70. The umbilical 70 may include one or more hydraulic or electric control conduit/cables for the actuators. The accumulators 44 may store pressurized hydraulic fluid for operating the BOPS 42*a,u,b*. Additionally, the accumulators 44 may be used for operating one or more of the other components of the PCA 1*p*. The umbilical 70 may further include hydraulic, electric, and/or optic control conduit/cables for operating various functions of the PCA 1*p*. The PLC 75 may operate the PCA 1*p* via the umbilical 70 and the control pod 76.

A lower end of the booster line 27 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 27 may be connected to an outlet of a booster pump (not shown). A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 76. The lines 27, 28 and umbilical 70 may extend between the MODU 1*m* and the PCA 1*p* by being fastened to brackets disposed along the riser 25. Each line 27, 28 may be a flow conduit, such as coiled tubing. Each shutoff valve 45*a-e* may be automated and have a hydraulic actuator (not shown) operable by the control pod 76 via fluid communication with a respective umbilical conduit or the LMRP accumulators 44. Alternatively, the valve actuators may be electrical or pneumatic.

The riser 25 may extend from the PCA 1*p* to the MODU 1*m* and may connect to the MODU via the UMRP 20. The UMRP 20 may include a diverter 21, a flex joint 22, a slip (aka telescopic) joint 23, a tensioner 24, and a rotating control device (RCD) 26. A lower end of the RCD 26 may be connected to an upper end of the riser 25, such as by a flanged connection. The slip joint 23 may include an outer barrel connected to an upper end of the RCD 26, such as by a flanged connection, and an inner barrel connected to the flex joint 22, such as by a flanged connection. The outer barrel may also be connected to the tensioner 24, such as by a tensioner ring (not shown).

The flex joint 22 may also connect to the diverter 21, such as by a flanged connection. The diverter 21 may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

The RCD 26 may include a housing, a piston, a latch, and a rider. The housing may be tubular and have one or more sections connected together, such as by flanged connections. The rider may include a bearing assembly, one or more stripper seals, and a catch, such as a sleeve. The rider may be selectively longitudinally and torsionally connected to the housing by engagement of the latch with the catch sleeve. The housing may have hydraulic ports in fluid communication with the piston and an interface of the RCD. The bearing assembly may be connected to the stripper seals. The bearing assembly may allow the stripper seals to rotate relative to the housing. The bearing assembly may include one or more radial bearings, one or more thrust bearings, and a self contained lubricant system.

Each stripper seal may be directional and oriented to seal against the drill pipe 10*p* in response to higher pressure in the riser 25 than the UMRP 20 (components thereof above the RCD). In operation, the drill pipe 10*p* may be received through the rider so that the stripper seals may engage the drill pipe in response to sufficient pressure differential. Each stripper seal may also be flexible enough to seal against an outer surface of the drill pipe 10*p* having a pipe diameter and an outer surface of threaded couplings of the drill pipe having a larger tool joint diameter. The RCD 26 may provide a desired barrier in the riser 25 either when the drill pipe is stationary or rotating. Alternatively, an active seal RCD may be used. The RCD housing may be submerged adjacent the waterline 2*s*. The RCD interface may be in fluid communication with an auxiliary hydraulic power unit (HPU) (not shown) of the PLC 75 via an auxiliary umbilical 71.

Alternatively, the rider may be non-releasably connected to the housing. Alternatively, the RCD may be located above the waterline and/or along the UMRP at any other location besides a lower end thereof. Alternatively, the RCD may be located at an upper end of the UMRP and the slip joint 23 and bracket connecting the UMRP to the rig may be omitted or the slip joint may be locked instead of being omitted. Alternatively, the RCD may be assembled as part of the riser at any location therealong.

The fluid handling system 1*h* may include a return line 29, mud pump 30*d*, one or more hydraulic power units (HPUs) 30*h* (one shown in FIG. 1A and two shown in FIG. 5A), a bypass line 31*p,h*, one or more hydraulic lines 31*c*, a drain line 32, a solids separator, such as a shale shaker 33, one or more flow meters 34*b,d,r*, one or more pressure sensors 35*b,d,r*, one or more variable choke valves, such as chokes 36*f,r*, an overpressure valve 36*p*, a supply line 37*p,h*, one or more shutoff valves 38*a-d*, a hydraulic manifold 39, one or more check valves 65*a,b* and a clamp 200.

Figures 3A, 3B:
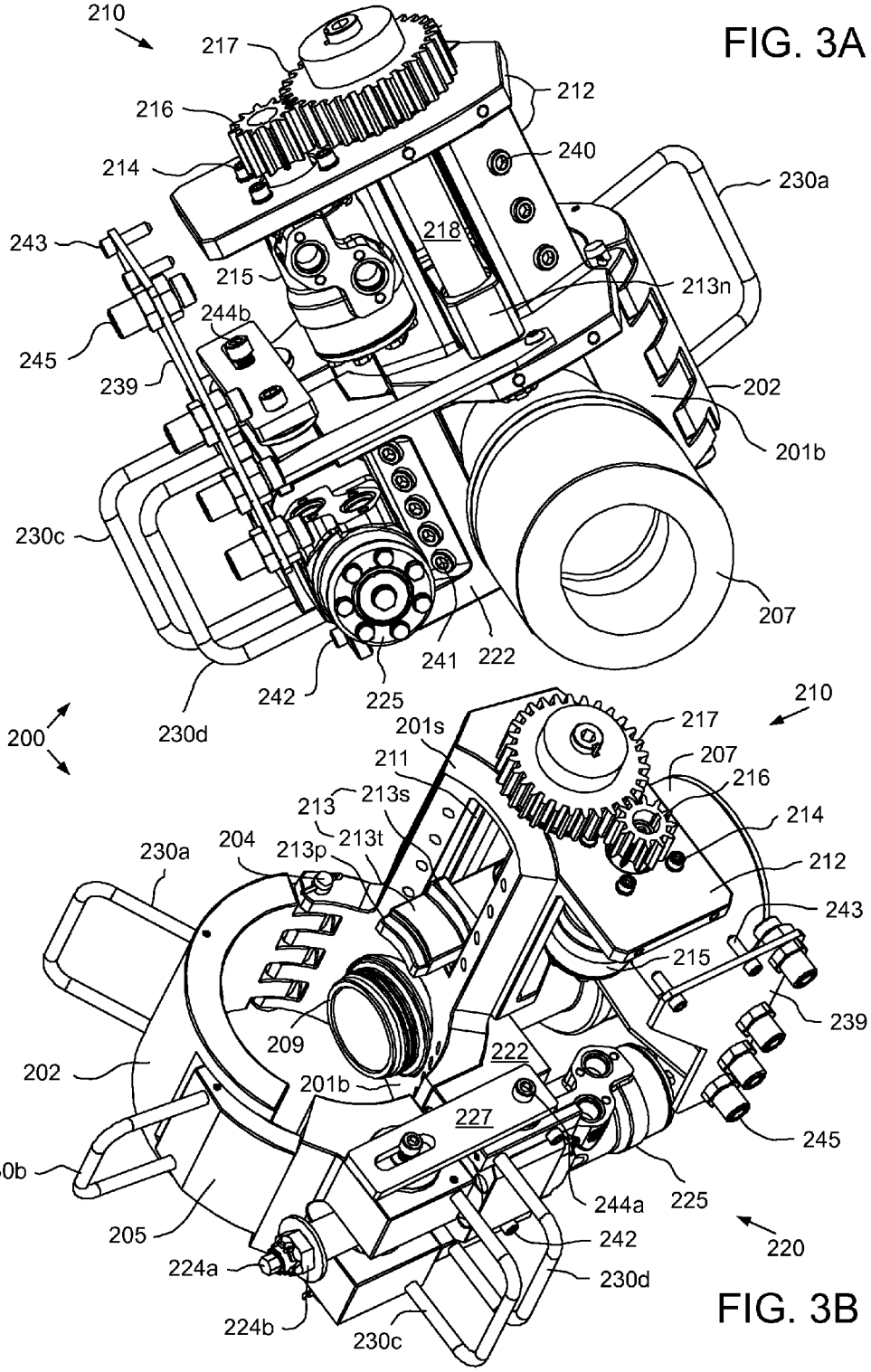
FIGS. 3A-3D illustrates a clamp of the drilling system.
Figures 3C, 3D:
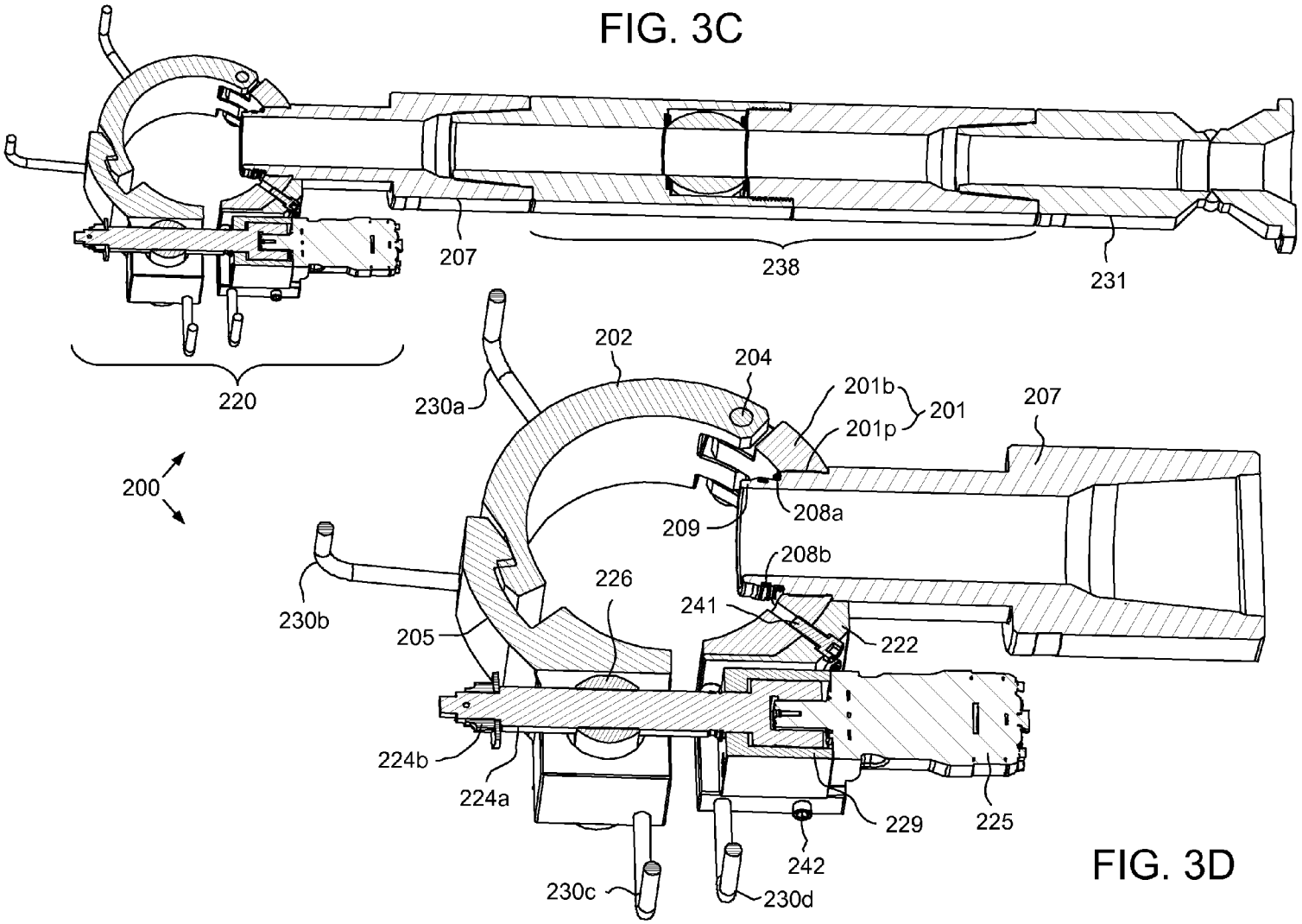

A lower end of the return line 29 may be connected to an outlet of the RCD 26 and an upper end of the return line may be connected to an inlet of the mud pump 30*d*. The returns pressure sensor 35*r*, returns choke 36*r*, returns flow meter 34*r*, and shale shaker 33 may be assembled as part of the return line 29. Alternatively, the return line 29 may further include a gas detector. The gas detector may include a probe having a membrane for sampling gas from the returns 60*r*, a gas chromatograph, and a carrier system for delivering the gas sample to the chromatograph. A lower end of the supply line 37*p,h* may be connected to an outlet of the mud pump 30*d* and an upper end of the supply line may be connected to an inlet of the top drive 5. The supply pressure sensor 35*d*, supply flow meter 34*d*, and supply shutoff valve 38*a* may be assembled as part of the supply line 37*p,h*. A first end of the bypass line 31*p,h* may be connected to an outlet of the mud pump 30*d* and a second end of the bypass line may be connected to an inlet 207 (FIG. 3A) of the clamp 200. The bypass pressure sensor 35*b*, bypass flow meter 34*b*, and bypass shutoff valve 38*b* may be assembled as part of the bypass line 31*p,h*.

A first end of the drain line 32 may be connected to the return line 29 and a second portion of the drain line may have prongs (four shown). A first drain prong may be connected to the bypass line 31*p,h*. A second drain prong may be connected to the supply line 37*p,h*. Third and fourth drain prongs may be connected to an outlet of the mud pump 30*d*. The supply drain valve 38*c*, bypass drain valve 38*d*, overpressure valve 36*p*, flow choke 36*f*, and check valves 65*a,b* may be assembled as part of the drain line 32. A first end of the hydraulic lines 31*c* may be connected to the HPU 30*h* and a second end of the hydraulic lines may be connected to the clamp 200. The hydraulic manifold 39 may be assembled as part of the hydraulic lines 31*c*.

Each choke 36*f,r* may include a hydraulic actuator operated by the PLC 75 via the auxiliary HPU (not shown). The returns choke 36*r* may be operated by the PLC to maintain backpressure in the riser 25. The flow choke 36*f* may be operated (FIG. 5B) by the PLC 75 to prevent a flow rate supplied to the flow sub 100 and clamp 200 in bypass mode (FIG. 5A) from exceeding a maximum allowable flow rate of the flow sub and/or clamp. Alternatively, the choke actuators may be electrical or pneumatic. The overpressure valve 36*p* may be a shutoff valve and have a hydraulic actuator (not shown) operable by the PLC 75 via the auxiliary HPU to protect against overpressure of the clamp 200 by the mud pump 30*d*. Each shutoff valve 38*a-d* may be automated and have a hydraulic actuator (not shown) operable by the PLC 75 via the auxiliary HPU. Alternatively, the valve actuators may be electrical or pneumatic.

Each pressure sensor 35*b,d,r* may be in data communication with the PLC 75. The returns pressure sensor 35*r* may be operable to measure backpressure exerted by the returns choke 36*r*. The supply pressure sensor 35*d* may be operable to measure standpipe pressure. The bypass pressure sensor 35*b* may be operable to measure pressure of the clamp inlet 207. The returns flow meter 34*r* may be a mass flow meter, such as a Coriolis flow meter, and may be in data communication with the PLC 75. The returns flow meter 34*r* may be connected in the return line 29 downstream of the returns choke 36*r* and may be operable to measure a flow rate of the returns 60*r*. Each of the supply 34*d* and bypass 34*b* flow meters may be a volumetric flow meter, such as a Venturi flow meter. The supply flow meter 34*d* may be operable to measure a flow rate of drilling fluid supplied by the mud pump 30*d* to the drill string 10 via the top drive 5. The bypass flow meter 34*b* may be operable to measure a flow rate of drilling fluid supplied by the mud pump 30*d* to the clamp inlet 207. The PLC 75 may receive a density measurement of the drilling fluid 60*d* from a mud blender (not shown) to determine a mass flow rate of the drilling fluid. Alternatively, the bypass 34*b* and supply 34*d* flow meters may each be mass flow meters.

In the drilling mode, the mud pump 30*d* may pump drilling fluid 60*d* from the shaker 33 (or fluid tank connected thereto), through the pump outlet, standpipe 37*p* and Kelly hose 37*h* to the top drive 5. The drilling fluid 60*d* may include a base liquid. The base liquid may be base oil, water, brine, or a water/oil emulsion. The base oil may be diesel, kerosene, naphtha, mineral oil, or synthetic oil. The drilling fluid 60*d* may further include solids dissolved or suspended in the base liquid, such as organophilic clay, lignite, and/or asphalt, thereby forming a mud.

The drilling fluid 60*d* may flow from the Kelly hose 37*h* and into the drill string 10 via the top drive 5 and Kelly valve 11. The drilling fluid 60*d* may flow down through the drill string 10 and exit the drill bit 15, where the fluid may circulate the cuttings away from the bit and return the cuttings up an annulus 95 formed between an inner surface of the casing 91 or wellbore 90 and an outer surface of the drill string 10. The returns 60*r* (drilling fluid 60*d* plus cuttings) may flow through the annulus 95 to the wellhead 50. The returns 60*r* may continue from the wellhead 50 and into the riser 25 via the PCA 1*p*. The returns 60*r* may flow up the riser 25 to the RCD 26. The returns 60*r* may be diverted by the RCD 26 into the return line 29 via the RCD outlet. The returns 60*r* may continue through the returns choke 36*r* and the flow meter 34*r*. The returns 60*r* may then flow into the shale shaker 33 and be processed thereby to remove the cuttings, thereby completing a cycle. As the drilling fluid 60*d* and returns 60*r* circulate, the drill string 10 may be rotated 16 by the top drive 5 and lowered by the traveling block 6, thereby extending the wellbore 90 into the lower formation 94*b*.

The PLC 75 may be programmed to operate the returns choke 36*r* so that a target bottomhole pressure (BHP) is maintained in the annulus 95 during the drilling operation. The target BHP may be selected to be within a drilling window defined as greater than or equal to a minimum threshold pressure, such as pore pressure, of the lower formation 94*b* and less than or equal to a maximum threshold pressure, such as fracture pressure, of the lower formation, such as an average of the pore and fracture BHPs. Alternatively, the minimum threshold may be stability pressure and/or the maximum threshold may be leakoff pressure. Alternatively, threshold pressure gradients may be used instead of pressures and the gradients may be at other depths along the lower formation 94*b* besides bottomhole, such as the depth of the maximum pore gradient and the depth of the minimum fracture gradient. Alternatively, the PLC 75 may be free to vary the BHP within the window during the drilling operation.

A static density of the drilling fluid 60*d* (typically assumed equal to returns 60*r*; effect of cuttings typically assumed to be negligible) may correspond to a threshold pressure gradient of the lower formation 94*b*, such as being equal to a pore pressure gradient. Alternatively, a static density of the drilling fluid 60*d* may be slightly less than the pore pressure gradient such that an equivalent circulation density (ECD) (static density plus dynamic friction drag) during drilling is equal to the pore pressure gradient. Alternatively, a static density of the drilling fluid 60*d* may be slightly greater than the pore pressure gradient. During the drilling operation, the PLC 75 may execute a real time simulation of the drilling operation in order to predict the actual BHP from measured data, such as standpipe pressure from sensor 35*d*, mud pump flow rate from the supply flow meter 34*d*, wellhead pressure from an of the sensors 47*a-c*, and return fluid flow rate from the return flow meter 34*r*. The PLC 75 may then compare the predicted BHP to the target BHP and adjust the returns choke 36*r* accordingly.

During the drilling operation, the PLC 75 may also perform a mass balance to monitor for a kick (not shown) or lost circulation (not shown). As the drilling fluid 60*d* is being pumped into the wellbore 90 by the mud pump 30*d* and the returns 60*r* are being received from the return line 29, the PLC 75 may compare the mass flow rates (i.e., drilling fluid flow rate minus returns flow rate) using the respective flow meters 34*d,r*. The PLC 75 may use the mass balance to monitor for formation fluid (not shown) entering the annulus 95 and contaminating the returns 60*r* or returns 60*r* entering the formation 94*b*.

Upon detection of either event, the PLC 75 may take remedial action, such as diverting the flow of returns 60*r* from an outlet of the returns flow meter to a degassing spool (not shown). The degassing spool may include automated shutoff valves at each end and a mud-gas separator (MGS). A first end of the degassing spool may be connected to the returns line 29 between the returns flow meter and the shaker 33 and a second end of the degasser spool may be connected to an inlet of the shaker. The MGS may include an inlet and a liquid outlet assembled as part of the degassing spool and a gas outlet connected to a flare or a gas storage vessel. The PLC 75 may also adjust the returns choke 36*r* accordingly, such as tightening the choke in response to a kick and loosening the choke in response to loss of the returns.

Alternatively, the PLC 75 may estimate a mass rate of cuttings (and add the cuttings mass rate to the intake sum) using a rate of penetration (ROP) of the drill bit or a mass flow meter may be added to the cuttings chute of the shaker and the PLC may directly measure the cuttings mass rate.

Figure 2A:
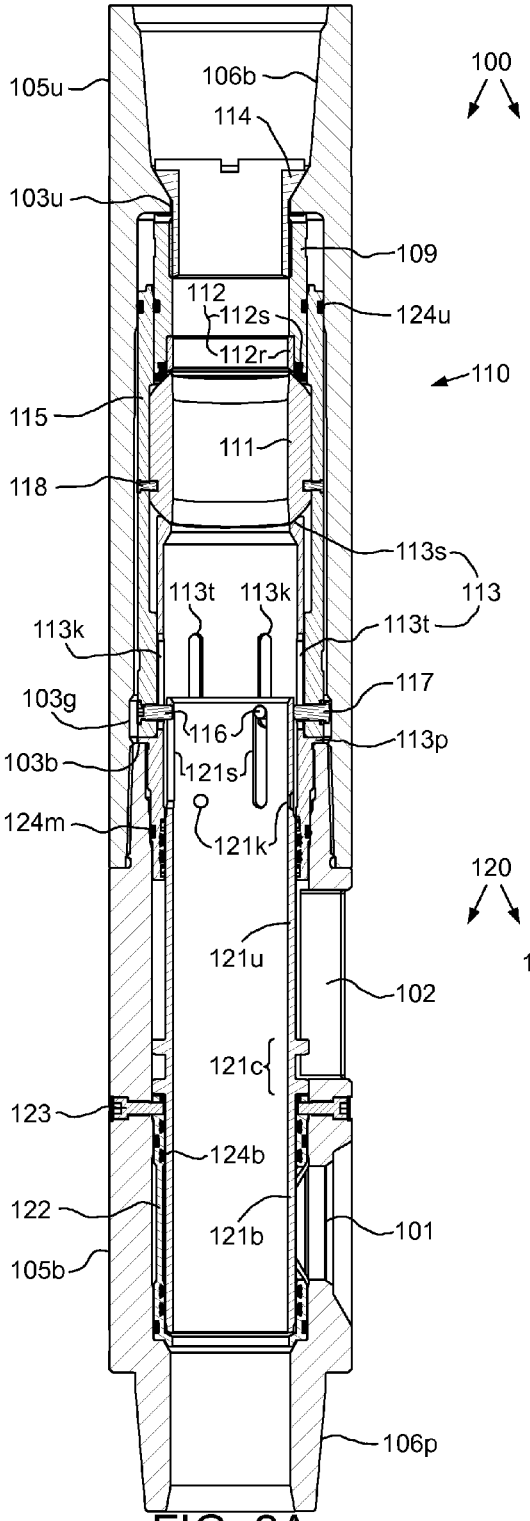
FIGS. 2A and 2B illustrate a flow sub of the drilling system in a top injection mode.
Figure 2B:
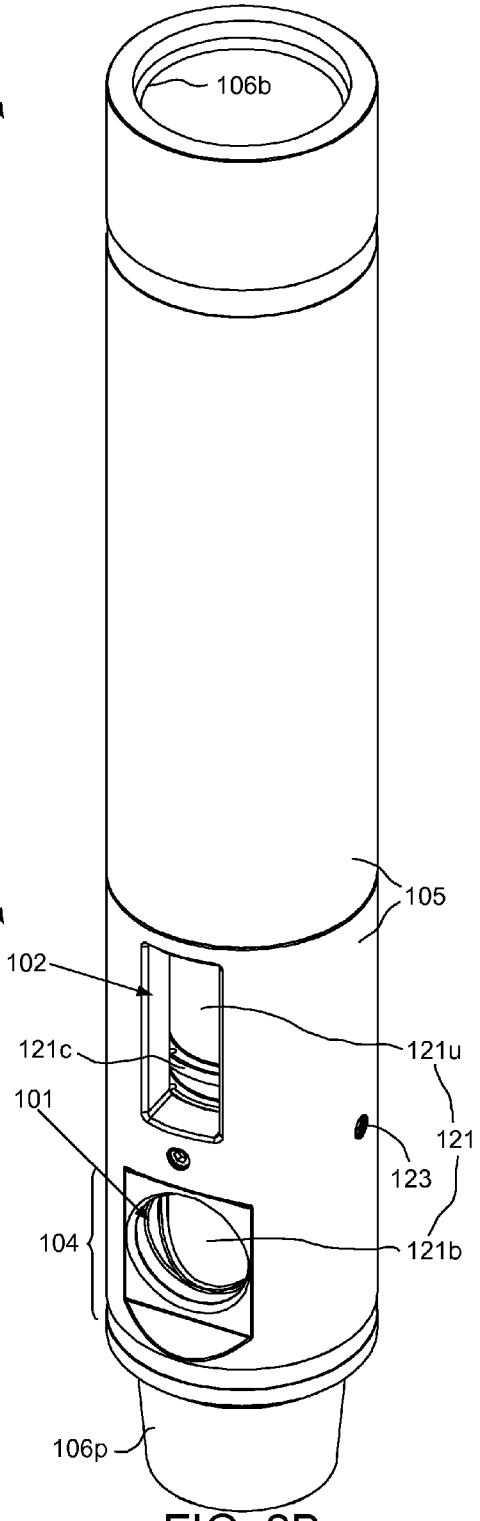

FIGS. 2A and 2B illustrate the flow sub 100 in a top injection mode. The flow sub 100 may include a tubular housing 105, a bore valve 110, a bore valve actuator, and a side port valve 120. The housing 105 may include one or more sections, such as an upper section 105*u* and a lower 105*b* section, each section connected together, such as by a threaded connection. An outer diameter of the housing 105 may correspond to the tool joint diameter of the drill pipe 10*p* to maintain compatibility with the RCD 26. The housing 105 may have a central longitudinal bore formed therethrough and a radial flow port 101 formed through a wall thereof in fluid communication with the bore (when the port valve is open) and located at a side of the lower housing section 105*b*. Alternatively, the side port 101 may be inclined between the radial and longitudinal axes of the housing 105. The housing 105 may also have a threaded coupling at each longitudinal end, such as box 106*b* formed in an upper longitudinal end and a pin 106*p* formed on a lower longitudinal end, so that the housing may be assembled as part of the drill string 10. Except for seals and where otherwise specified, the flow sub 100 may be made from a metal or alloy, such as steel, stainless steel, or a nickel based alloy. Seals may be made from an elastomer or elastomeric copolymer and may include backup rings and/or energizing springs.

A length of the housing 105 may be equal to or less than the length of a standard joint of drill pipe 10*p*. A length of the housing 105 may be substantially less than the length of a standard joint of drill pipe 10*p*, such as less than or equal to one-third or one-sixth the length, so that the flow sub 100 may be connected to one or more joints of drill pipe 10*p* to form a stand 10*s* with only a negligible increase in length than if the stand was formed without the flow sub. The compactness of the flow sub 100 allows the stand 10*s* to have the same number of drill pipe joints as a stand that would be normally used with the rig 1*r*.

The bore valve 110 may include a closure member, such as a ball 111, a seat 112, a body 109, 113, and a fastener 114. The body 109, 113 may include one or more sections, such as an upper tube section 109 and a lower sleeve section 113. The lower body section 113 may be disposed within the housing 105 and connected thereto. The lower body section 113 may have a lip 113*p* formed in an outer surface thereof and a threaded coupling formed in the outer surface adjacently below the lip. The lower housing section 105*b* may have a threaded coupling formed in an inner surface thereof and adjacent to an upper end 103*b* thereof for mating with the lower body section threaded coupling. A lower face of the lip 113*p* may also receive the upper end 103*b*.

Upper seals 124*u* may be disposed between the housing 105 and the cam 115 and between the upper body section 113*u* and the cam to isolate the interfaces thereof. The upper housing section 105*u* may have a shoulder 103*u* formed in an inner surface thereof and adjacently below the box 106*b*. The shoulder 103*u* may have a tapered upper face and a flat lower face. The fastener 114 may be annular and have a threaded coupling formed in an outer surface thereof and extending from a lower end thereof and a tapered shoulder formed in the outer surface and extending from an upper end thereof.

The upper body section 109 may be disposed within the housing 105 and have a threaded coupling formed in an inner surface thereof and extending from an upper end thereof. Mating of the fastener thread with the upper body thread and engagement of the fastener shoulder with the housing shoulder 103*u* may connect the upper body section 109 to the housing 105. The seat 112 may include a seal 112*s* and a retainer 112*r*. The upper body section 109 may have a recess formed in an inner surface thereof and extending from a bottom thereof for receiving the seat retainer 112*r*. The seat retainer 112*r* may be connected to the upper body section 109, such as by press fit or a threaded connection. The seat seal 112*s* may be connected to the upper body section 109, such as by a lip and groove connection and by being disposed between the upper body section and the seat retainer 112*r*. The seat seal 112*s* may be annular and have a tapered inner surface conforming to an outer surface of the ball 111 for sealing engagement therewith. The lower body section 113 may have a tapered stop shoulder 113*s* formed in an inner surface thereof, extending from an upper end thereof, and conforming to the ball outer surface. Alternatively, a lower seat may be used instead of the stopper 113*s*.

The ball 111 may be disposed between the body sections 109, 113 and may be rotatable relative thereto. The ball 111 may be operable between an open position (FIGS. 2A, 4A, 4B, 4E, and 4F) and a closed position (FIGS. 4D, and 5A) by the bore valve actuator. The ball 111 may have a bore formed therethrough corresponding to the housing bore and aligned therewith in the open position. A wall of the ball 111 may close an upper portion of the housing bore in the closed position and the ball may engage the seat seal 112*s* in response to pressure exerted against the ball by fluid injection into the side port 101.

The port valve 120 may include a closure member, such as a sleeve 121, and a seal mandrel 122. The seal mandrel 122 may be made from an erosion resistant material, such as tool steel, ceramic, or cermet. The seal mandrel 122 may be disposed within the housing 105 and connected thereto, such as by one or more (two shown) fasteners 123. The seal mandrel 122 may have a port formed through a wall thereof corresponding to and aligned with the side port 101. Lower seals 124*b* may be disposed between the housing 105 and the seal mandrel 122 and between the seal mandrel and the sleeve 121 to isolate the interfaces thereof. The port valve 120 may have a maximum allowable flow rate greater than, equal to, or slightly less than a flow rate of the drilling fluid 60*d* in drilling mode.

The valve sleeve 121 may be disposed within the housing 105 and longitudinally moveable relative thereto between an open position (FIG. 4D) and a closed position (FIGS. 2A, 2B, 4A, and 4H) by the clamp 200. In the open position, the side port 101 may be in fluid communication with a lower portion of the housing bore. In the closed position, the valve sleeve 121 may isolate the side port 101 from the housing bore by engagement with the lower seals 124*b* of the seal sleeve 122. The valve sleeve 121 may include an upper portion 121*u*, a lower portion 121*b*, and a lug 121*c* disposed between the upper and lower portions.

A window 102 may be formed through a wall of the lower housing section 105*b* and may extend a length corresponding to a stroke of the port valve 120. The window 102 may be aligned with the side port 101. The lug 121*c* may be accessible through the window 102. A recess 104 may be formed in an outer surface of the lower housing section 105*b* adjacent to the side port 101 for receiving a stab connector 209 formed at an end of an inlet 207 of the clamp 200. Mid seals 124*m* may be disposed between the housing 105 and the lower body section 113*b* and between the lower body section and the sleeve 121 to isolate the interfaces thereof.

The bore valve actuator may be mechanical and include a cam 115, one or more (two shown) followers 118, a linkage, and a toggle. An upper annulus may be formed between the body 109, 113 and the upper housing section 105*u* and a lower annulus may be formed between the valve sleeve 121 and the lower housing section 105*b*. The cam 115 may be disposed in the upper annulus and may be longitudinally movable relative to the housing 105. Each follower 118 may be a threaded fastener connected to the cam 115 by being received in a threaded socket thereof. The cam 115 may interact with the ball 111, such as by the followers 118 extending into a respective cam profile (not shown) formed in an outer surface of the ball 111 or vice versa. The ball-cam interaction may rotate the ball 111 between the open and closed positions in response to longitudinal movement of the cam 115 relative to the ball. The cam 115 may have a recess formed in an inner surface thereof to accommodate interaction with the ball and one or more windows (not shown) to facilitate assembly therewith.

The cam 115 may also interact with the valve sleeve 121 via the linkage and the toggle. The linkage may include one or more (two shown) pins 116, inner slots 121*s*, and outer slots 113*k*. The toggle may include one or more (one shown) pins 117, one or more (two shown) slots 113*t* and sockets 121*k*, and a groove 103*g*. Each linkage pin 116 may be threaded and connected to the cam 115 by being received in a threaded socket thereof. A shank of each linkage pin 116 may extend through the respective outer slot 113*k* formed through a wall of the lower body section 113 and into the respective inner slot 121*s* formed through a wall of the sleeve upper portion 121*u*.

Each toggle pin 117 may be longitudinally connected to the cam 115 by extending through a socket thereof. Each toggle pin 117 may be radially movable between an engaged position (FIGS. 4C-4E and 5A) and a disengaged position (FIGS. 2A, 4A, 4G, and 4H). Each toggle pin 117 may be aligned with the groove 103*g* formed in an inner surface of the upper housing section 105*u* in the disengaged position and float between engagement with an outer surface of the valve sleeve 121 and the groove. In the engaged position, a shank of each toggle pin 117 may be aligned with and extend into the respective toggle socket 121*k* formed through a wall of the valve sleeve upper portion 121*u*, thereby longitudinally connecting the valve sleeve 121 and the cam 115. Each socket 121*k* may be countersunk and the groove 103*g* may have a tapered upper end for pushing the respective toggle pin 117 between the positions. The toggle sockets 121*k* may be aligned with a bottom of the inner linkage slots 121*s*. The linkage pins 116 and toggle pins 117 may be aligned. The outer linkage slots 113*k* and toggle slots 113*t* may be aligned and have equal widths and lengths. The toggle and linkage members may be spaced around the flow sub 100 in an alternating fashion.

Figure 4A:
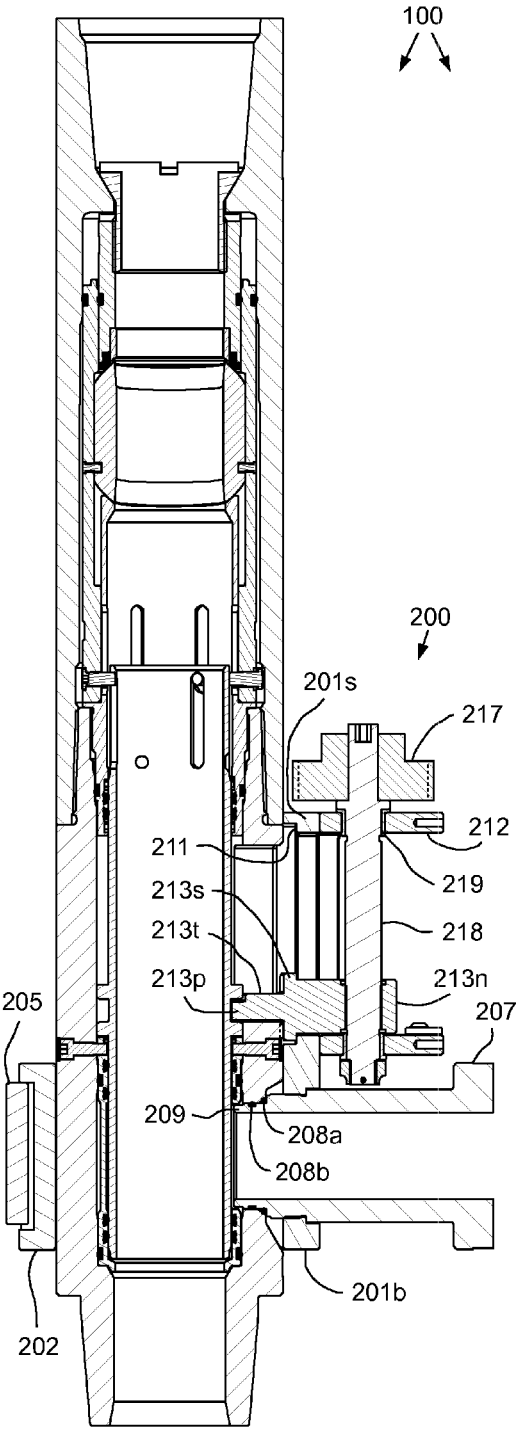
FIGS. 4A-4H illustrates operation of the flow sub and the clamp.
Figure 4B:
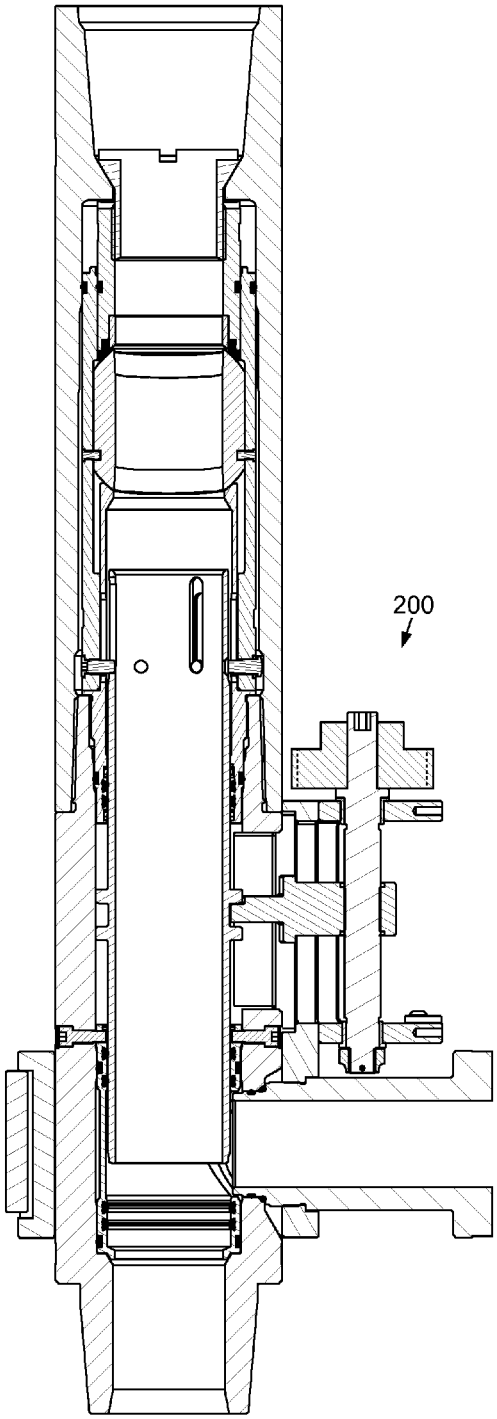

During an upstroke (FIGS. 4A-4D) of the flow sub 100, the linkage may longitudinally connect the cam 115 and the valve sleeve 121 after allowing a predetermined amount of longitudinal movement therebetween. A stroke of the cam 115 may be less than a stroke of the valve sleeve 121, such that when coupled with the lag created by the linkage, the bore valve 110 and the port valve 120 may never both be fully closed simultaneously (FIG. 4B). During a downstroke (FIGS. 4E-4H) of the flow sub 100, the engaged toggle may longitudinally connect the cam 115 and the valve sleeve 121 before disengaging such that the bore valve 110 and the port valve 120 may never both be fully closed simultaneously (FIG. 4F).

FIGS. 3A-3D illustrates the clamp 200. The clamp 200 may include a body 201, a band 202, a latch 205 operable to fasten the band to the body, an inlet 207, one or more actuators, such as port valve actuator 210 and a band actuator 220, and a hub 239. The clamp 200 may be movable between an open position (not shown) for receiving the flow sub 100 and a closed position for surrounding an outer surface of the lower housing segment 105*b*. The body 201 may have a lower base portion 201*b* and an upper stem portion 201*s*. The body 201 may have a coupling, such as a hinge portion, formed at an end of the base portion 201*b*, and the band 202 may have a mating coupling, such as a hinge portion, formed at a first end thereof. The hinge portions may be connected by a fastener, such as a pin 204, thereby pivotally connecting the band 202 and the body 201. The band 202 may have a lap formed at a second end thereof for mating with a complementary lap formed at an end of the latch 205. Engagement of the laps may form a lap joint to circumferentially connect the band 202 and the latch 205.

The body 201 may have a port 201*p* formed through the base portion 201*b* for receiving the inlet 207. The inlet 207 may be connected to the body 201, such as by a threaded connection. A mud saver valve (MSV) 238 may be connected to the inlet 207, such as by a threaded connection. An adapter 231 may be connected to the MSV 238 such as by a threaded connection. The adapter 231 may have a coupling, such as flange, for receiving a flexible conduit, such as bypass hose 31*h*. The inlet 207 may further have one or more seals 208*a,b* and a stab connector 209 formed at an end thereof engaging a seal face of the flow sub 100 adjacent to the side port 101.

The port valve actuator 210 may include the stem portion 201*s*, a bracket 212, a yoke 213, a hydraulic motor 215, and a gear train 216, 217. The body 201 may have a window formed through the stem portion 201*s* and guide profiles, such as tracks 211, formed in an inner surface of the stem portion adjacent to the window. The yoke 213 may extend through the window and have a nut portion 213*n*, slider portion 213*s*, and tongue portion 213*t*. The slider portion 213*s* may be engaged with the tracks 211, thereby allowing longitudinal movement of the yoke 213 relative to the body 201. The yoke 213 may have an engagement profile, such as a lip 213*p*, formed at an end of the tongue portion 213*t* for engaging a groove formed in an outer surface of the lug 121*c*, thereby longitudinally connecting the yoke with the flow sub sleeve 121. The hydraulic motor 215 may have a stator connected to the bracket 212, such as by one or more (four shown) fasteners 214, and a rotor connected to a drive gear 216 of the gear train 216, 217. The motor 215 may be bidirectional.

The drive gear 216 may be connected to a yoke gear 217 by meshing of teeth thereof. The yoke gear 217 may be connected to a lead screw 218, such as by interference fit or key/keyway. The nut portion 213*n* may be engaged with the lead screw 218 such that the yoke 213 may be being raised and lowered by respective rotation of the lead screw. The bracket 212 may be connected to the body 201, such as by one or more (three shown) fasteners 240. The lead screw 218 may be supported by the bracket 212 for rotation relative thereto by one or more bearings 219 (FIG. 4A). The motor 215 may be operable to raise and lower the yoke 213 relative to the body 201, thereby also operating the flow sub sleeve 121 when the clamp 200 is engaged with the flow sub 100 (FIGS. 4A-4F). Alternatively, the motor 215 may be electric or pneumatic.

The band actuator 220 may be operable to tightly engage the clamp 200 with the lower housing section 105*b* after the latch 105 has been fastened. The band actuator 220 may include a bracket 222, a hydraulic motor 225, a bearing 229, and a tensioner 224*a,b*, 226. The tensioner 224*a,b*, 226 may include a tensioner bolt 224*a*, a stopper 224*b*, and a tubular tensioner nut 226. The motor 225 may have a stator connected to the bearing 229, such as by one or more fasteners (not shown) and a rotor connected to a tensioner bolt 224*a*. The motor 225 may be bidirectional. The tensioner bolt 224*a* may be supported from the body 201 for rotation relative thereto by the bearing 229. The bracket 222 may be connected to the body 201, such as by one or more (five shown) fasteners 241. The bearing 229 may be connected to the bracket 222, such as by a fastener 242.

The latch 205 may include an opening formed therethrough for receiving the tensioner nut 226 and a cavity formed therein for facilitating assembly of the tensioner 224*a,b*, 226. To further facilitate assembly, the tensioner nut 226 may be connected to a bar 227, such as by fastener 244*b* and a pin (slightly visible in FIG. 3B). The bar 227 may have a slot formed therethrough to accommodate operation of the tensioner 224*a,b*, 226. The bar 227 may also be connected to the bracket, such as by fastener 244*a*. The tensioner nut 226 may rotate relative to the opening and may have a threaded bore for receiving the tensioner bolt 224*a*. Rotation of the tensioner nut 226 may prevent binding of the tensioner bolt 224*a* and may allow replacement due to wear. A stopper 224*b* may be connected to the bolt 224*a* with a threaded connection. To engage the clamp 200 with the flow sub 100, the body 201 may be aligned with the flow sub 100, the band 202 wrapped around the flow sub 100 and the latch 205 engaged with the band 202. The motor 225 may then be operated, thereby tightening the clamp 200 around the lower housing section 105*b*. Alternatively, the motor 225 may be electric or pneumatic.

To facilitate manual handling, the clamp 200 may further include one or more handles 230*a-d*. A first handle 230*a* may be connected to the band 202, such as by a fastener. Second 230*b* and third 230*c* handles may be connected to the latch 205, such as by respective fasteners. A fourth handle 230*d* may be connected to the bracket 222, such as by a fastener. A hub 239 may be connected to the bracket 212, such as by one or more (two shown) fasteners 243. The hub 239 may include one or more (four shown) hydraulic connectors 245 for receiving respective hydraulic lines 31*c* from the hydraulic manifold 39. The hub 239 may also include internal hydraulic conduits (not shown), such as tubing, connecting the connectors 245 to respective inlets and outlets of the hydraulic motors 215, 225.

Each hydraulic motor 215, 225 may further include a motor lock operable between a locked position and an unlocked position. Each motor lock may include a clutch torsionally connecting the respective rotor and the stator in the locked position and disengaging the respective rotor from the respective stator in the unlocked position. Each clutch may be biased toward the locked position and further include an actuator, such as a piston, operable to move the clutch to the unlocked position in response to hydraulic fluid being supplied to the respective motor. Alternatively each lock may have an additional hydraulic port for supplying the actuator.

Alternatively, the band 202 and latch 205 may be replaced by automated (i.e., hydraulic) jaws. Additionally, the clamp 200 may be deployed using a beam assembly. The beam assembly may include a one or more fasteners, such as bolts, a beam, such as an I-beam, a fastener, such as a plate, and a counterweight. The counterweight may be clamped to a first end of the beam using the plate and the bolts. A hole may be formed in the second end of the beam for connecting a cable (not shown) which may include a hook for engaging the hoist ring. One or more holes (not shown) may be formed through a top of the beam at the center for connecting a sling which may be supported from the derrick 3 by a cable. Using the beam assembly, the clamp 200 may be suspended from the derrick 3 and swung into place adjacent the flow sub 100 when needed for adding stands 10*s* to the drill string 10 and swung into a storage position during drilling.

Alternatively, the clamp 200 may be deployed using a telescopic arm. The telescopic arm may include a piston and cylinder assembly (PCA) and a mounting assembly. The PCA may include a two stage hydraulic PCA mounted internally of the arm which may include an outer barrel, an intermediate barrel and an inner barrel. The inner barrel may be slidably mounted in the intermediate barrel which is, may be in turn, slidably mounted in the outer barrel. The mounting assembly may include a bearer which may be secured to a beam by two bolt and plate assemblies. The bearer may include two ears which accommodate trunnions which may project from either side of a carriage. In operation, the clamp 200 may be moved toward and away from the flow sub 100 by extending and retracting the hydraulic piston and cylinder.

FIGS. 4A-4H illustrates operation of the flow sub 100 and the clamp 200. FIG. 5A illustrates the drilling system 1 in a bypass mode. FIGS. 5B and 5C illustrate shifting of the drilling system 1 between the modes. Referring specifically to FIG. 5A, the MSV 238 may be manually operated. A position sensor 250 may be operably coupled to the MSV 238 for determining a position (open or closed) of the MSV. The position sensor 250 may be in data communication with the PLC 75. Alternatively, the MSV 238 may be automated.

The fluid handling system 1*h* may further include a second HPU 30*h* and a second manifold 39. Although two HPUs 30*h* and two manifolds 39 are shown for operation of the clamp 200, the clamp 200 may be operated with only one HPU and one manifold as shown in FIG. 1A. Each HPU 30*h* may include a pump, an accumulator, a check valve, a reservoir having hydraulic fluid, and internal hydraulic conduits connecting the pump, reservoir, accumulator, and check valve. Each HPU 30*h* may further include a pressurized port in fluid communication with the respective accumulator and a drain port in fluid communication with the reservoir. Each hydraulic manifold 39 may include one or more automated shutoff valves 39*a-d*, 39*e-h* in communication with the PLC 75. Each manifold 39 may have a pressurized inlet in connected to a first respective pair of the shutoff valves and a drain inlet in fluid communication with a second respective pair of shutoff valves. Each manifold 39 may also have first and second outlets, each outlet connected to a shutoff valve of each pair. A first portion of the hydraulic lines 31*c* may connect respective inlets of the manifolds to respective inlets of the HPUs. A second portion of the hydraulic lines 31*c* may connect respective outlets of the manifolds to respective hydraulic connectors 245 of the clamp hub 239. Alternatively, each manifold 39 may include one or more directional control valves, each directional control valve consolidating two or more of the shutoff valves 39*a-h*.

Referring specifically to FIGS. 4A and 5A-5C, once it is necessary to extend the drill string 10, drilling may be stopped by stopping advancement and rotation 16 of the top drive 5 and removing weight from the drill bit 15. A spider (not shown) may then be operated to engage the drill string 10, thereby longitudinally supporting the drill string 10 from the rig floor 4. The clamp 200 may then be transported to the flow sub 100 and closed around the flow sub lower housing section 105*b*. The PLC 75 may then operate the band actuator 220 by opening manifold valves 39*a,d*, thereby supplying hydraulic fluid to the band motor 225. Operation of the band motor 225 may rotate the tensioner bolt 224*a*, thereby tightening the clamp 200 into engagement with the flow sub lower housing 105*b*. The PLC 75 may then lock the band motor 225. The MSV 238 may be manually opened and then the rig crew may evacuate the rig floor 4.

The PLC 75 may then test engagement of the seals 208*a,b* by closing the bypass drain valve 38*d* and by opening the bypass valve 38*b* to pressurize the clamp inlet 207 and then closing the bypass valve. If the clamp seals 208*a,b* are not securely engaged with the lower housing section 105*b*, drilling fluid 60*d* will leak past the clamp seals. The PLC 75 may verify sealing integrity by monitoring the bypass pressure sensor 35*b*. The PLC may then reopen the bypass valve 38*b* to equalize pressure on the valve sleeve 121. The PLC 75 may then operate the port valve actuator 210 by opening manifold valves 39*f,h*, thereby supplying hydraulic fluid to the port motor 215. Operation of the port motor 215 may rotate the lead screw 218, thereby raising the yoke 213.

Referring specifically to FIG. 4B, when moved upwardly by the yoke 213, the sleeve 121 may move longitudinally relative to the cam 115 until the bottoms of the inner slots 121*s* engage the linkage pins 116, thereby longitudinally connecting the sleeve and the cam and aligning the toggle pins 117 with the sockets 121*k*. Due to the lag, discussed above, drilling fluid 60*d* may momentarily flow into the drill string 10 through both the side port 101 and the bore valve 110.

Figure 4C:
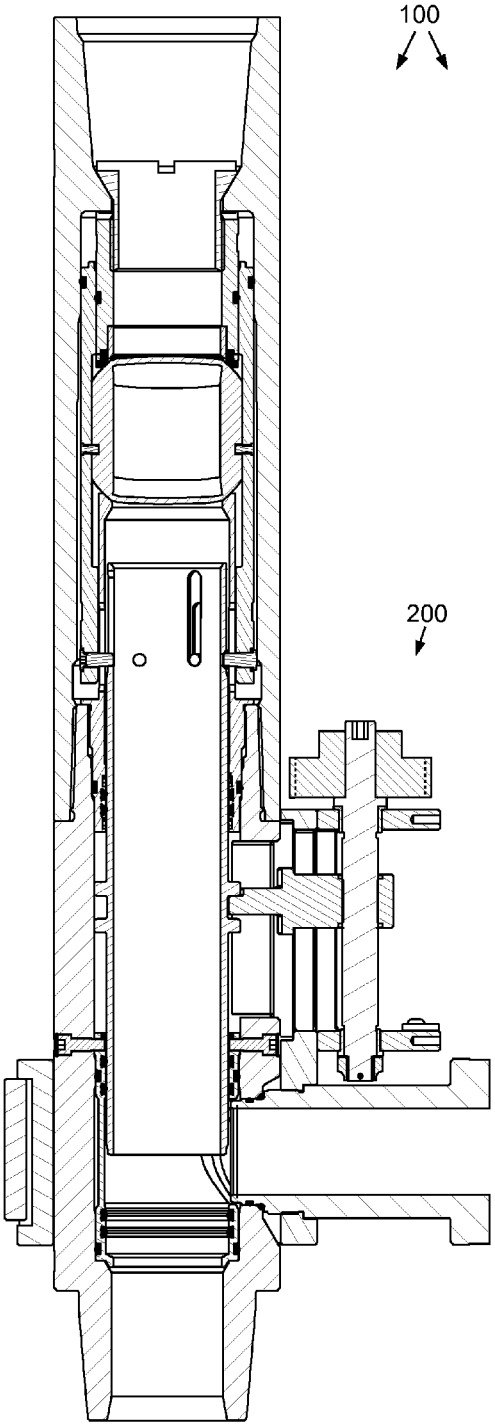
Figure 5A:
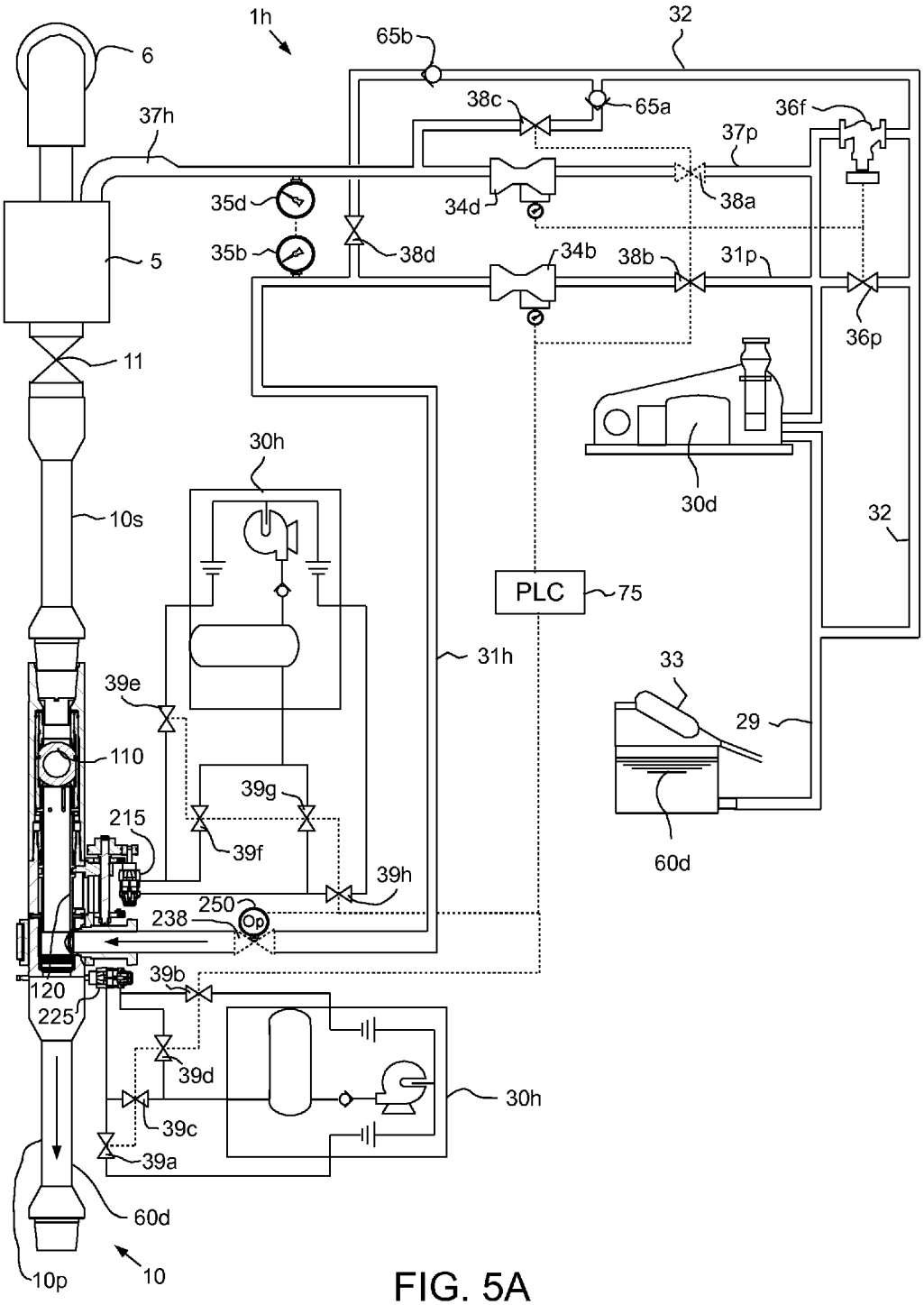
FIG. 5A illustrates the drilling system in a bypass mode.
Figure 6A:
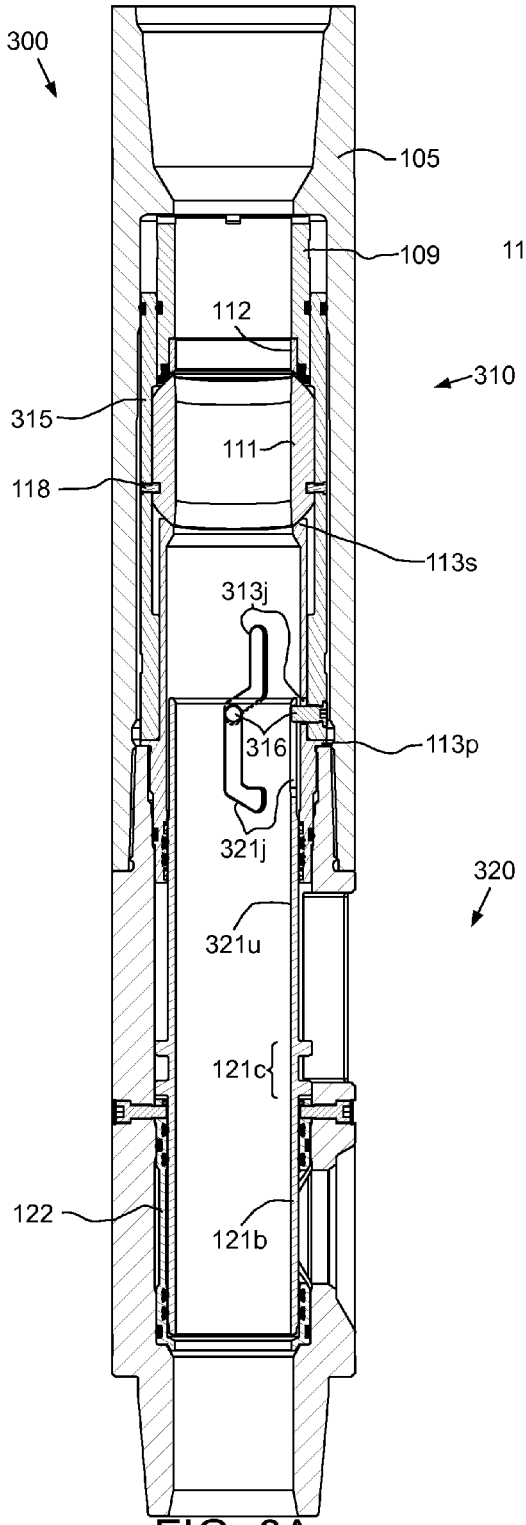
FIGS. 6A-6D illustrates a first alternative flow sub for use with the clamp, according to another embodiment of the present disclosure.
Figure 6B:
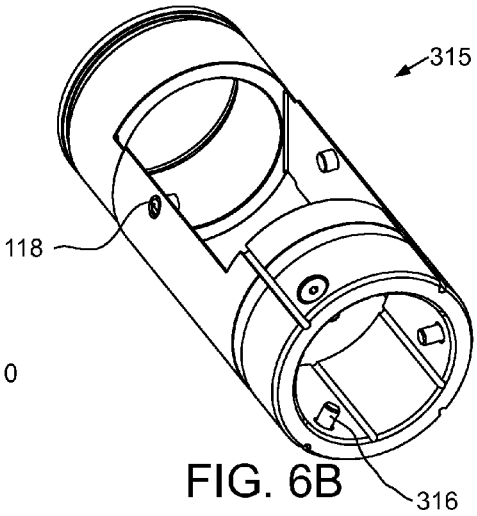
Figure 6C:
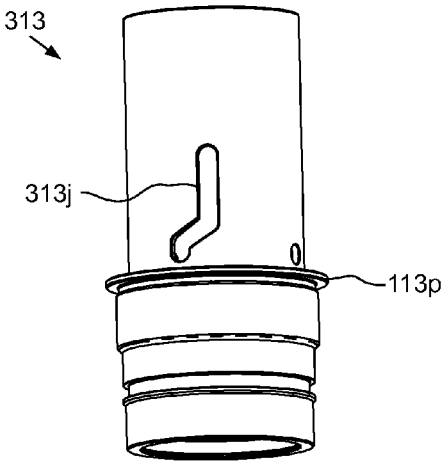
Figure 6D:
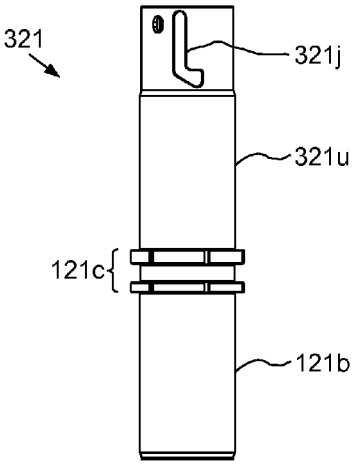

Referring specifically to FIG. 4C, continued upward movement of the sleeve 121 and the cam 115 may cause the toggle pins 117 to engage the tapered upper portion of the groove, thereby pushing the toggle pins inward into the sockets 121*k*. A transition or line fit between heads of the toggle pins 117 and an inner surface of the upper housing section 105*u* may trap the toggle pins in the engaged position. Also at this position, closing of the bore valve 110 has commenced.

Figure 4D:
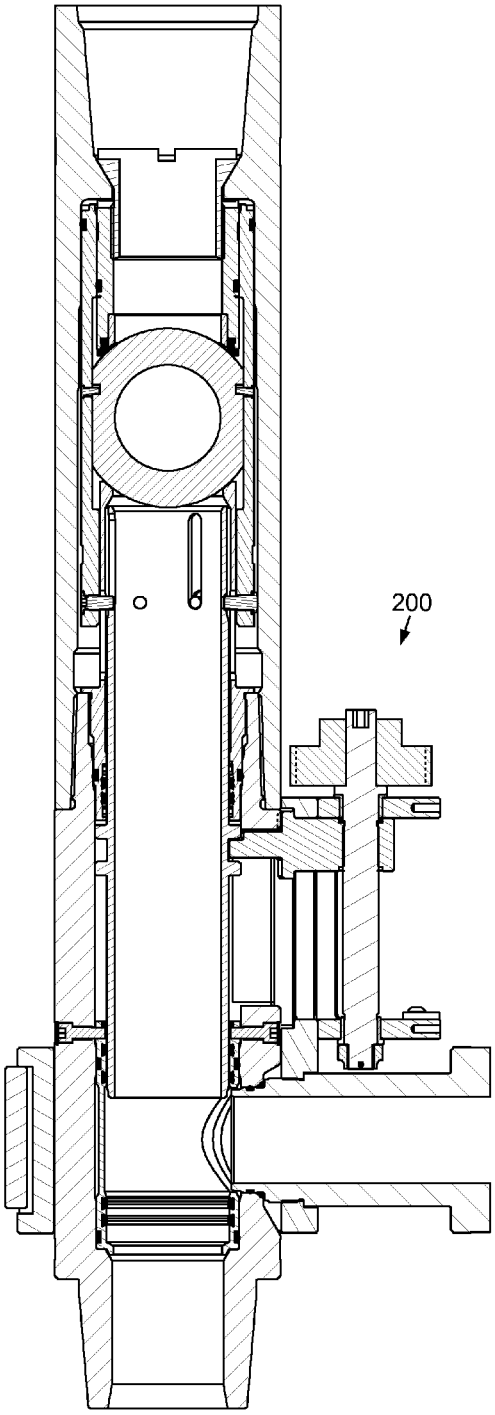

Referring specifically to FIG. 4D, upward movement of the sleeve 121 and the cam 115 may continue, thereby fully closing the bore valve 110. The upward movement may be halted by engagement of an upper shoulder of the yoke 213 with an upper shoulder of the stem portion 201*s* at which point the side port 101 is fully open.

Referring specifically to FIGS. 5A-5C, once the side port 101 is fully open, the PLC 75 may lock the port motor 215 and relieve pressure from the top drive 5 by closing the supply valve 38*a* and opening the supply drain valve 38*c*. The PLC 75 may then test integrity of the closed bore valve 110 by closing the supply drain valve 38*d*. If the bore valve 110 has not closed, drilling fluid 60*d* will leak past the bore valve. The PLC 75 may verify closing of the bore valve 110 by monitoring the supply pressure sensor 35*d*. The top drive 5 may then be operated to disconnect from the flow sub 100 and to hoist a stand 10*s* from pipe rack 17. The flow sub 100 may be assembled to form an upper end of the respective stand 10*s*. The top drive 5 may continue to be operated to connect to the flow sub 100 of the retrieved stand 10*s*. The top drive 5 may then be operated to connect a lower end of the stand 10*s* to the flow sub 100 of the drill string 10. Drilling fluid 60*d* may continue to be injected into the side port 101 (via the open supply valve 38*b* and MSV 238) during adding of the stand 10*s* by the top drive 5 at a flow rate corresponding to the flow rate in drilling mode. The PLC 75 may also utilize the bypass flow meter 34*b* for performing the mass balance to monitor for a kick or lost circulation during adding of the stand 10*s*.

Once the stand 10*s* has been added to the drill string 10, the PLC 75 may pressurize the added stand 10*s* by closing the supply drain valve 38*c* and opening the supply valve 38*a*. Once the stand 10*s* has been pressurized, the PLC 75 may then unlock the port motor 215. The PLC 75 may then reverse operate the port valve actuator 210 by opening manifold valves 39*e,g*, thereby reversing supply of the hydraulic fluid to the port motor 215. Operation of the port motor 215 may counter-rotate the lead screw 218, thereby lowering the yoke 213.

Figure 4E:
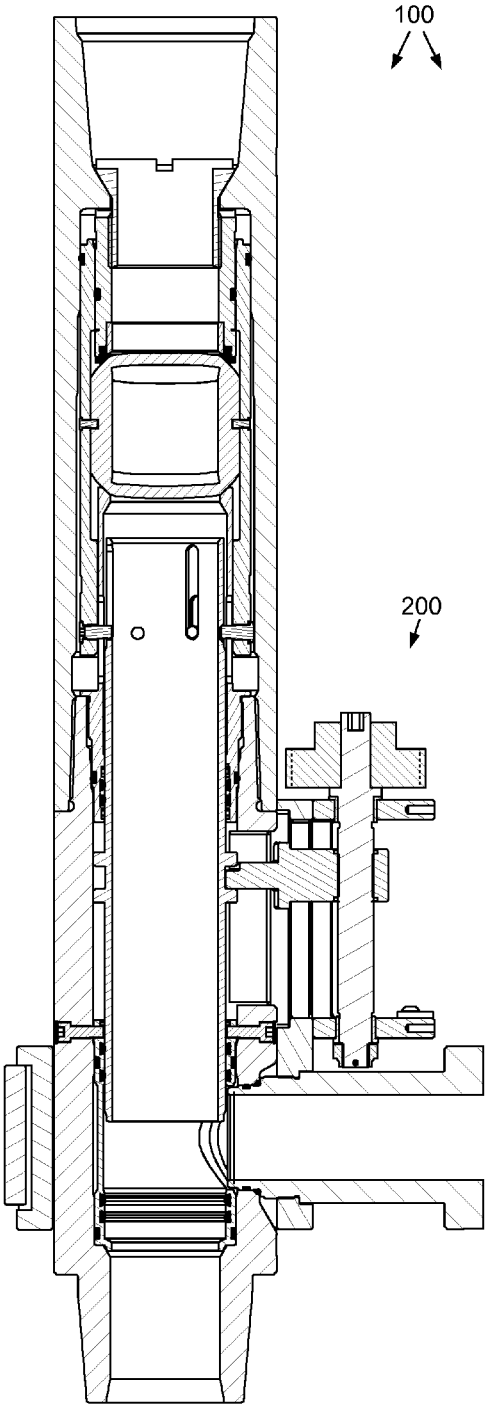
Figure 4F:
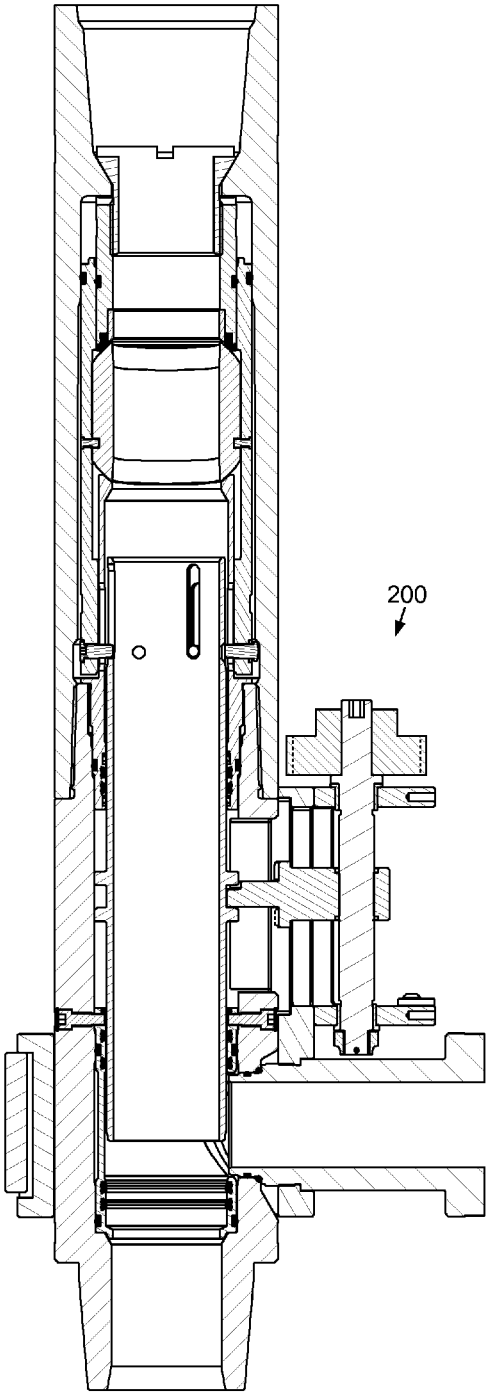

Referring specifically to FIG. 4E, lowering of the yoke 213 may cause downward movement of the valve sleeve 121 and the cam 115 due to the toggle pins 117 being engaged with the sockets 121*k*. The bore valve 110 may commence opening upon downward movement of the cam 115.

Referring specifically to FIG. 4F, downward movement of the valve sleeve 121 and the cam 115 may continue, thereby fully opening the bore valve 110 and aligning the toggle pins 117 with the groove 103*g*. Tapers in the sockets 121*k* may push the toggle pins 117 outward into the groove 103*g* once alignment has been reached, thereby releasing the cam 115 from the valve sleeve 121. Alternatively, the toggle pins 117 may not be pushed into the groove 103*g* until a bottom of the cam 115 engages a top face of the lip 113*p*. Due to the toggle, discussed above, drilling fluid 60*d* may momentarily flow into the drill string 10 through both the side port 101 and the bore valve 110.

Figure 4G:
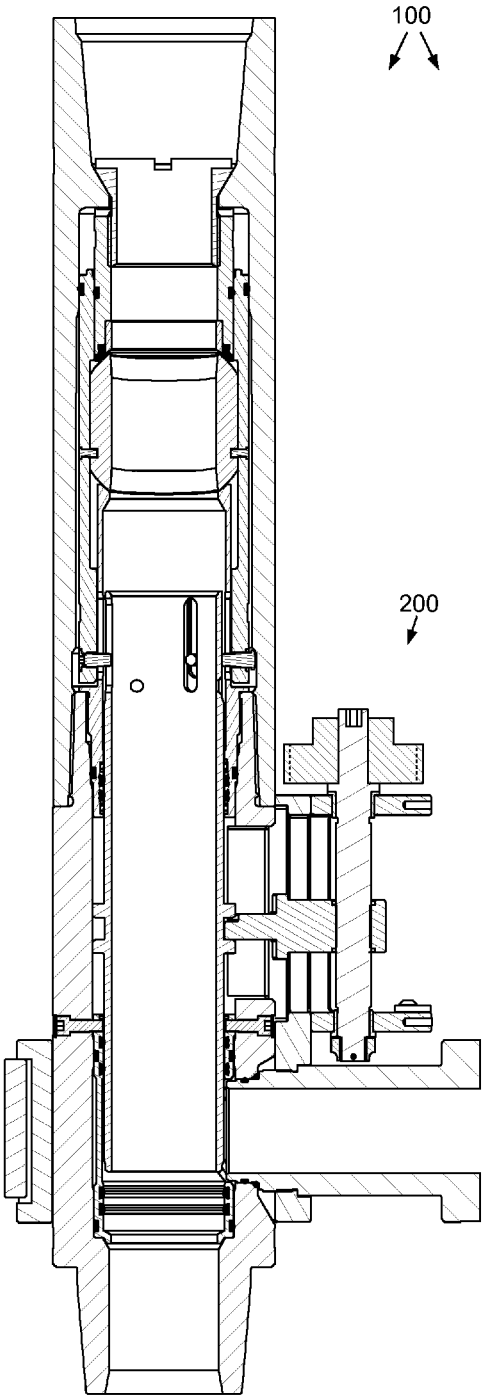

Referring specifically to FIG. 4G, downward movement of the valve sleeve 121 relative to the freed cam 115 may continue until the tops of the inner slots 121*s* engage the linkage pins 116, thereby longitudinally connecting the sleeve and the cam.

Figure 4H:
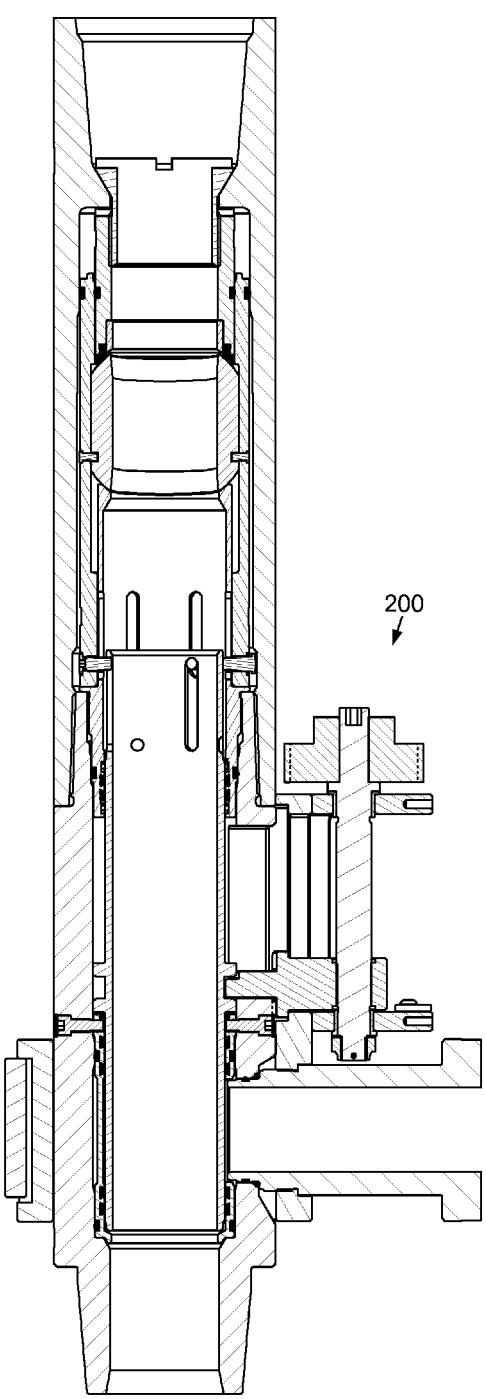

Referring specifically to FIG. 4H, downward movement of the sleeve 121 and the cam 115 may continue until a bottom of the cam 115 engages the top face of the lip 113*p* at which point the side port 101 is fully closed.

Referring specifically to FIGS. 5A-5C, once the side port 101 is fully closed, the PLC 75 may then relieve pressure from the clamp inlet 207 by closing the bypass valve 38*b* and opening the bypass drain valve 38*d*. The PLC 75 may then confirm closure of the valve sleeve 121 by closing the bypass drain valve 38*d* and monitoring the bypass pressure sensor 35*b*. Once closure of the valve sleeve 121 has been confirmed, the PLC 75 may open the bypass drain valve 38*d*. The rig crew may then return to the rig floor 4 and close the MSV 238. The PLC 75 may then unlock the band motor 225. The PLC 75 may then reverse operate the band actuator 220 by opening manifold valves 39*b,c*, thereby reversing supply of hydraulic fluid to the band motor 225. Operation of the band motor 225 may counter-rotate the tensioner bolt 224*a*, thereby loosening the clamp 200 from engagement with the flow sub lower housing 105*b*. The clamp 200 may then be opened and transported away from the flow sub 100. The spider may then be operated to release the drill string 10. Once released, the top drive 5 may be operated to rotate 16 the drill string 10. Weight may be added to the drill bit 15, thereby advancing the drill string 10 into the wellbore 90 and resuming drilling of the wellbore. The process may be repeated until the wellbore 90 has been drilled to total depth or to a depth for setting another string of casing.

A similar process may be employed if/when the drill string 10 needs to be tripped, such as for replacement of the drill bit 15 and/or to complete the wellbore 90. To disassemble the drill string 10, the drill string may be raised (while circulating drilling fluid via the top drive 5) until one of the flow subs 100 is at the rig floor 4. The spider may be set (if rotating 16 while tripping, rotation may be halted before setting the spider). The clamp 200 may be installed and tested. The drilling fluid flow may be switched to the clamp 200 and the bore valve 110 tested. The top drive 5 may then be operated to disconnect the stand 10*s* extending above the rig floor 4 and to hoist the stand to the pipe rack 17. The top drive 5 may then be connected to the flow sub 100 at the rig floor 4. The top drive 5 may then be pressurized and the drilling fluid flow switched to the top drive. The clamp 200 may be bled, the port valve tested, and the clamp removed. Tripping of the drill string from the wellbore may then continue until the drill bit 15 reaches the LMRP. At that point, the BOPs may be closed and circulation may be maintained using the booster 27 and choke 28 lines.

Alternatively, the method may be utilized for running casing or liner to reinforce and/or drill the wellbore 90, or for assembling work strings to place downhole components in the wellbore.

FIGS. 6A-6D illustrates a first alternative flow sub 300 for use with the clamp 200, according to another embodiment of the present disclosure. The first alternative flow sub 300 may include the housing 105, a bore valve 310, a bore valve actuator, and a side port valve 320.

The bore valve 310 may include the ball 111, the seat 112, a body, such as a body 109, 313, and the fastener (not shown, see fastener 114). The body 109, 113 may include one or more sections, such as the upper section 109 and a lower 313 section. The lower body section 313 may be disposed within the housing 105 and connected thereto. The lower body section 313 may have the lip 113*p* and the threaded coupling for connection to the housing 105.

The port valve 320 may include a closure member, such as a sleeve 321, and the seal mandrel 122. The valve sleeve 321 may be disposed within the housing 105 and longitudinally moveable relative thereto between an open position (FIG. 7D) and a closed position (FIG. 6A) by the clamp 200. The sleeve may include an upper portion 321*u*, a lower portion 121*b*, and a lug 121*c* disposed between the upper and lower portions.

The bore valve actuator may be mechanical and include a cam 315, the followers 118, and a combined linkage and a toggle. The cam 315 may interact with the valve sleeve 321 via the combined linkage and toggle. The combined linkage and toggle may include one or more (two shown) pins 316, inner J-slots 321*j*, and outer J-slots 313*j*. Each linkage/toggle pin 316 may be threaded and connected to the cam 315 by being received in a threaded socket thereof. A shank of each linkage/toggle pin 316 may extend through the respective outer J-slot 313*j* formed through a wall of the lower body section 313 and into the respective inner J-slot 321*s* formed through a wall of the sleeve upper portion 321*u*.

Each outer J-slot 313*j* may have an upper straight longitudinal portion, a lower pin receiver portion, and a mid inclined portion connecting the upper and lower portions. Each inner J-slot 321*j* may have an upper straight longitudinal portion and a lower pin articulation portion. Each pin articulation portion may have an upper tangential wall and a lower inclined wall forming a portion oversized relative to a shank diameter of the linkage/toggle pin 316 to accommodate movement of the pin in the inclined portion of the respective outer J-slot 313*j*. To also accommodate movement of the linkage/toggle pin 316 in both respective J-slots 313*j*, 321*j*, the valve sleeve 321 may be torsionally restrained from rotating relative to the cam 315 and lower body section 313 by: seal friction, friction with the engaged clamp yoke 213, and/or each of the lug 121*c* and the clamp yoke having mating anti-rotation features.

Figures 7A, 7B, 7C:
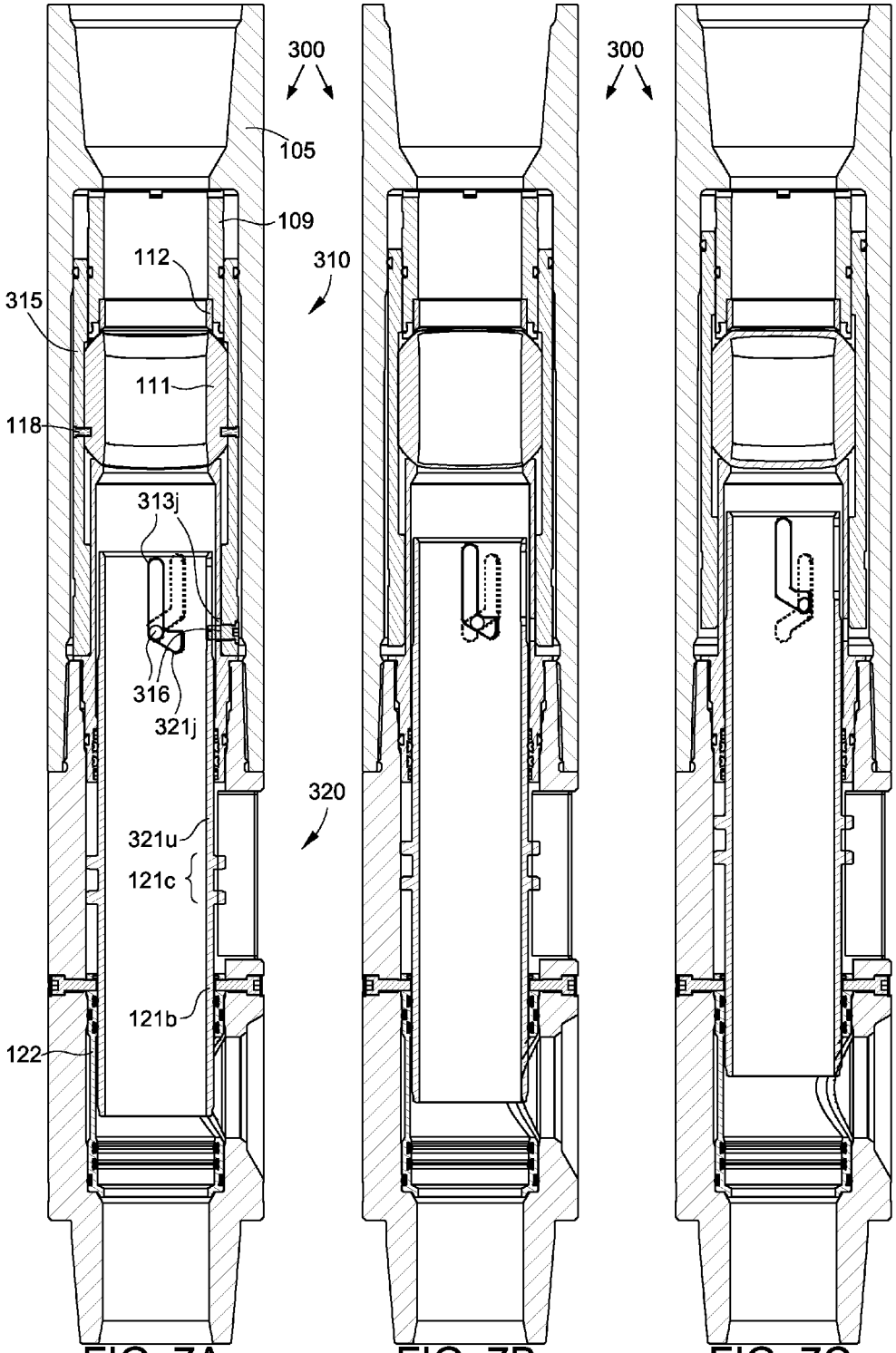
FIGS. 7A-7I illustrates operation of the first alternative flow sub.

During an upstroke (FIGS. 7A-7D) of the first alternative flow sub 300, the combined linkage and toggle may longitudinally connect the cam 315 and the valve sleeve 321 after allowing a predetermined amount of longitudinal movement therebetween. A stroke of the cam 315 may be less than a stroke of the sleeve 321, such that when coupled with the lag created by the combined linkage and toggle, the bore valve 310 and the port valve 320 may never both be fully closed simultaneously (FIG. 7A). During a downstroke (FIGS. 7E-7I) of the first alternative flow sub 300, the combined linkage and toggle may longitudinally connect the cam 315 and the sleeve 321 before allowing a predetermined amount of longitudinal movement therebetween such that the bore valve 310 and the port valve 320 may never both be fully closed simultaneously (FIG. 7I).

FIGS. 7A-7I illustrates operation of the first alternative flow sub 300. Once it is necessary to extend the drill string 10, drilling may be stopped by stopping advancement and rotation 16 of the top drive 5 and removing weight from the drill bit 15. A spider (not shown) may then be operated to engage the drill string 10, thereby longitudinally supporting the drill string 10 from the rig floor 4. The clamp 200 may then be transported to the first alternative flow sub 300 and closed around the flow sub lower housing section. The PLC 75 may then operate the band actuator 220, thereby tightening the clamp 200 into engagement with the flow sub lower housing. The MSV 238 may be manually opened and then the rig crew may evacuate the rig floor 4. After testing, the PLC 75 may then operate the port valve actuator 210, thereby rotating the lead screw 218 and raising the yoke 213.

Referring specifically to FIG. 7A, when moved upwardly by the yoke 213, the valve sleeve 321 may move longitudinally relative to the cam 315 until the inclined portions of the inner J-slots 321*j* engage the linkage/toggle pins 316, thereby coupling the sleeve and the cam. Due to the lag, discussed above, drilling fluid 60*d* may momentarily flow into the drill string 10 through both the port valve 320 and the bore valve 310.

Referring specifically to FIG. 7B, continued upward movement of the valve sleeve 321 may raise the linkage/toggle pins 316 from the receiver portions of the outer J-slots 313*j* and into the mid inclined portions thereof, thereby allowing the cam 315 to move upward and be rotated due to the pins sliding along the inclined lower walls of the inner J-slots 321*j*. The rotation of the cam 315 may be about a longitudinal axis of the housing 105 and may also cause rotation of the ball 111 therewith due to the engagement of the followers 118 with the ball cam profile. This rotation may not affect opening or closing of the bore valve 310 since rotation of the ball 111 between the open and closed positions may be about a transverse axis of the housing 105. Also at this position, closing of the bore valve 310 has commenced due to the transverse rotation of the ball 111 in response to the upward movement of the cam 315.

Referring specifically to FIG. 7C, upward movement of the sleeve 321 and upward and rotational movement of the cam 315 may continue, thereby further closing the bore valve 310. The rotation of the cam 315 may be halted by engagement of the upper straight portions of the outer J-slots 313*j* with the linkage/toggle pins 316 and this engagement may be accommodated by engagement of bottoms of the inner J-slots 321*j* with the pins.

Figures 7D, 7E, 7F:
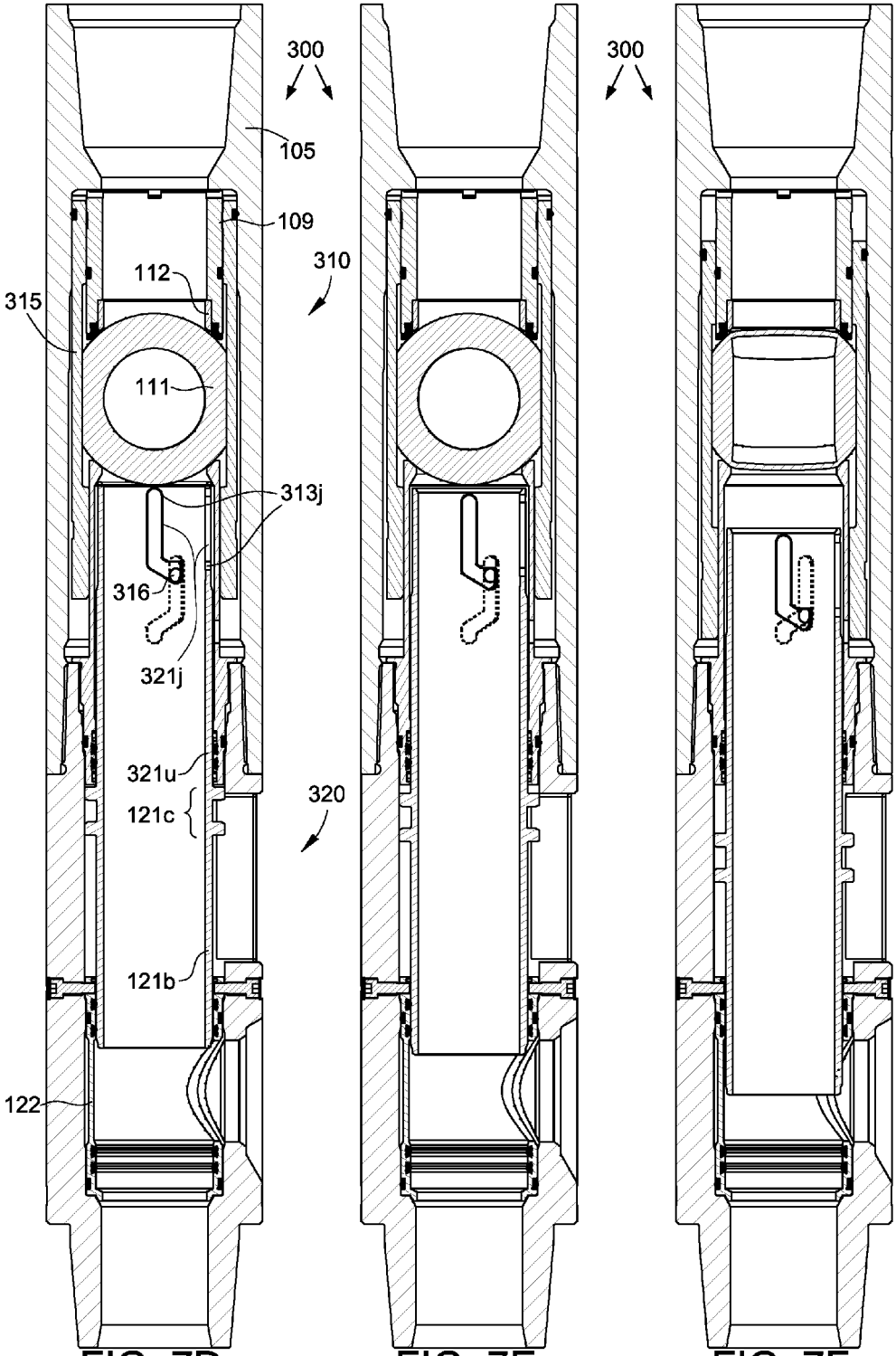
Figures 7G, 7H, 7I:
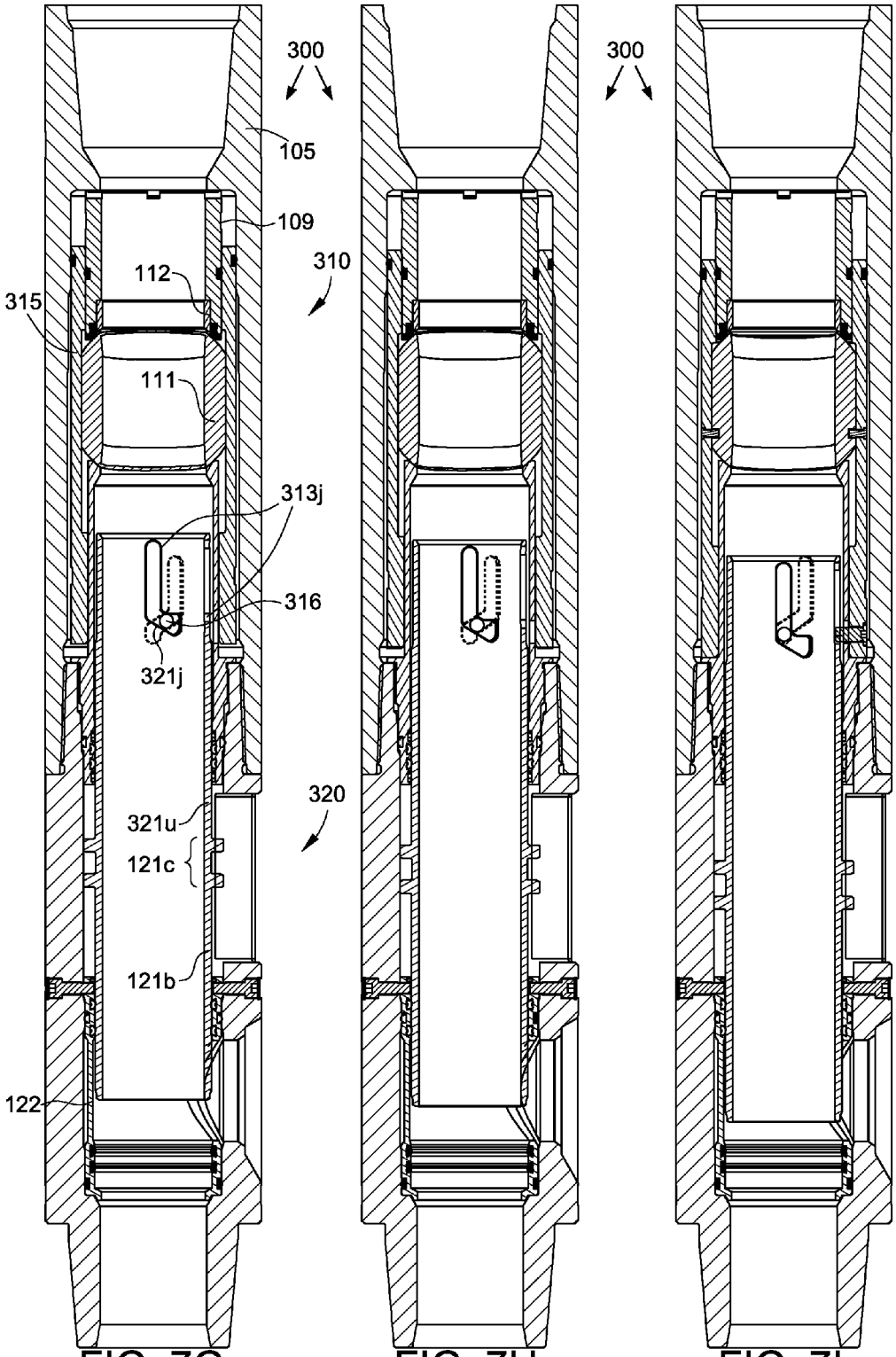
Figure 8A:
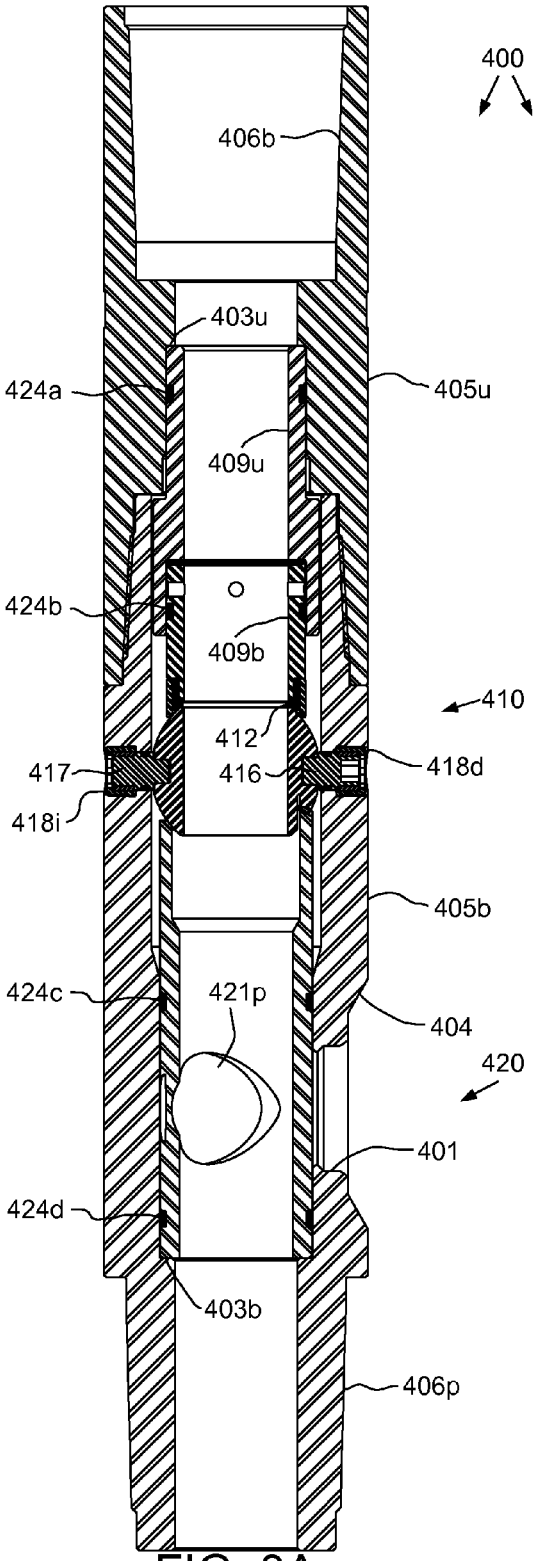
FIGS. 8A-8D illustrates a second alternative flow sub, according to another embodiment of the present disclosure.
Figure 8B:
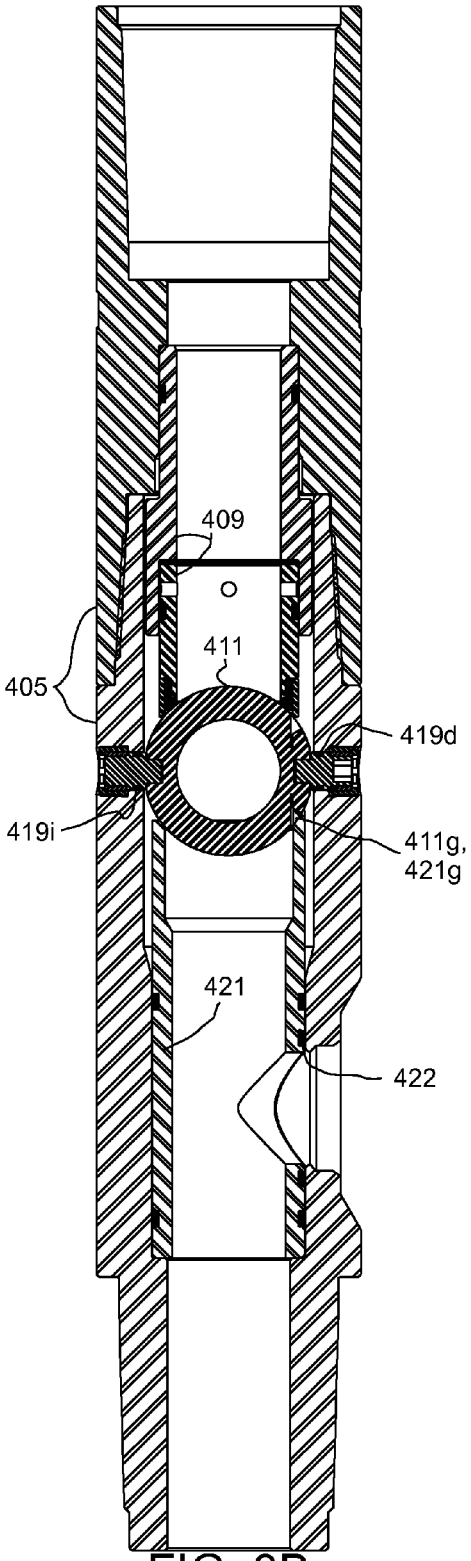
Figure 8C:
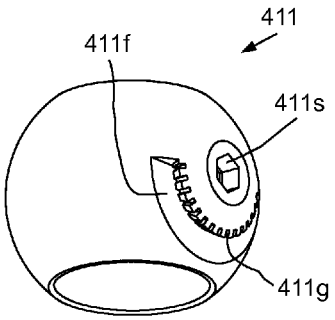
Figure 9C:
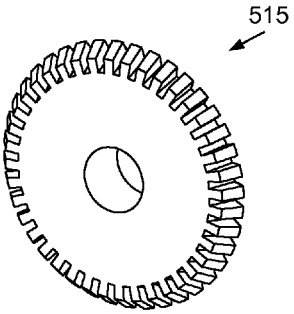
FIGS. 9A-9D illustrates a third alternative flow sub, according to another embodiment of the present disclosure.
Figure 10E:
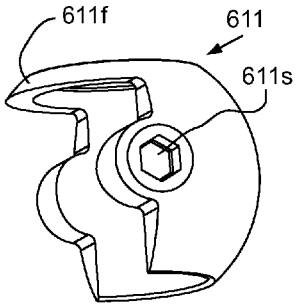
FIGS. 10A-10F illustrates a fourth alternative flow sub, according to another embodiment of the present disclosure.
Figure 8D:
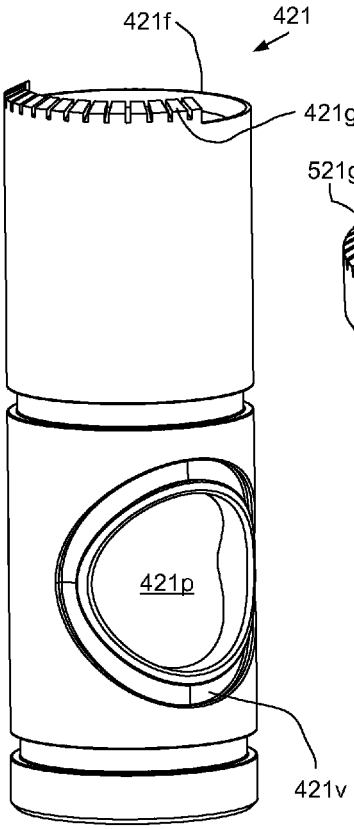
Figure 9D:
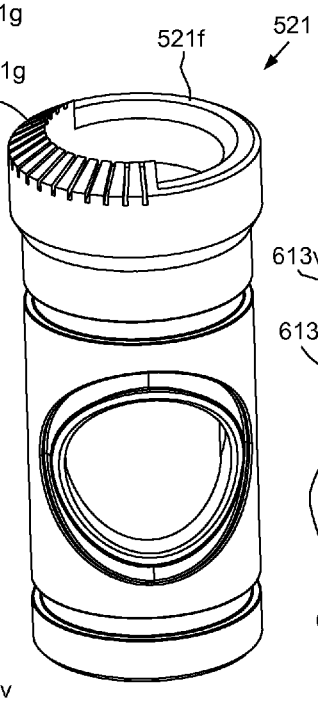
Figure 10F:
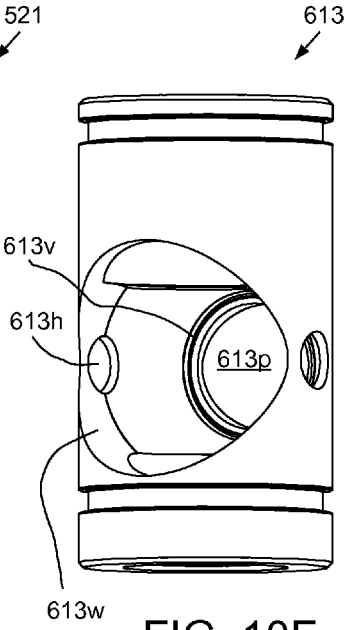
Figures 9A, 9B:
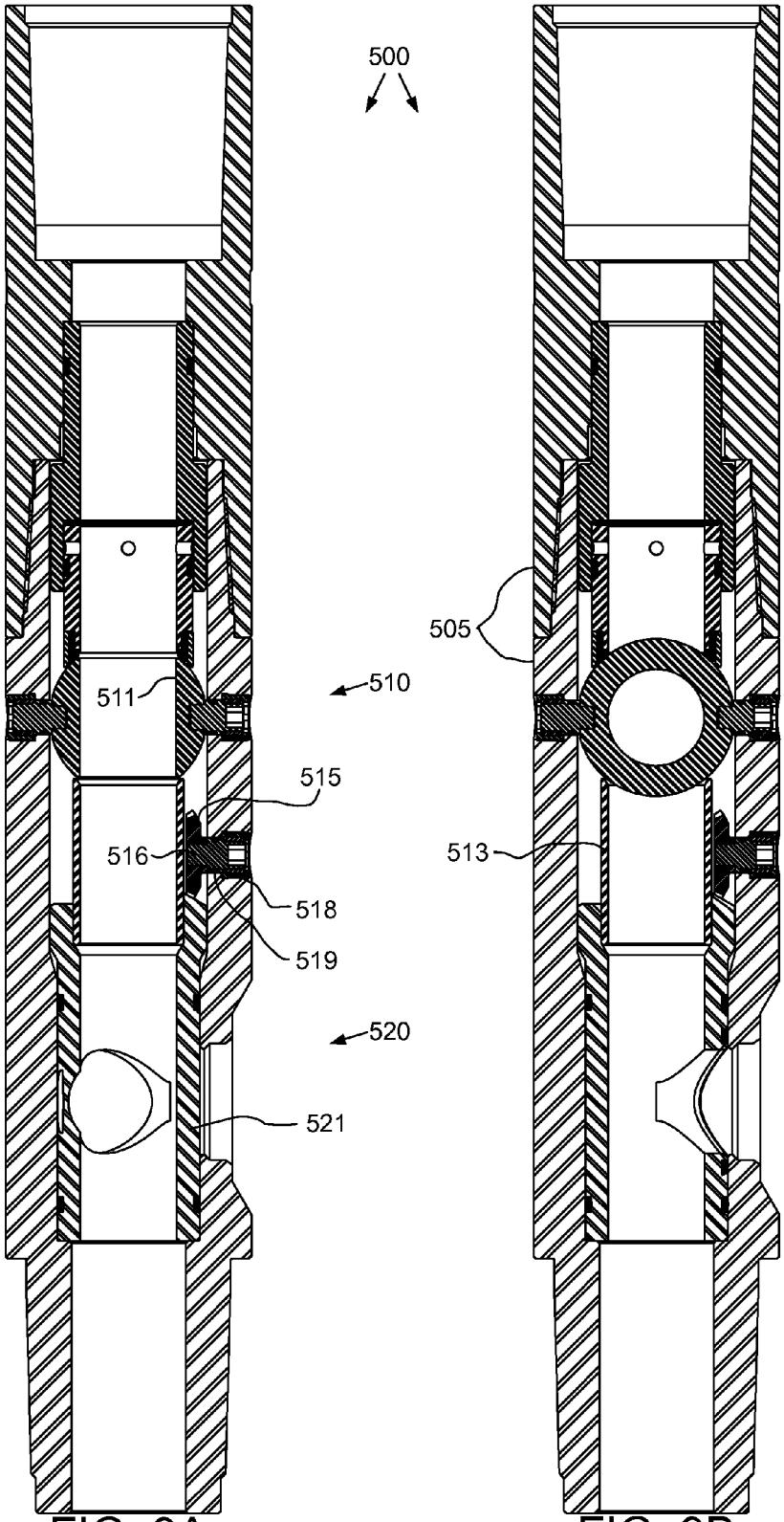
Figure 10A:
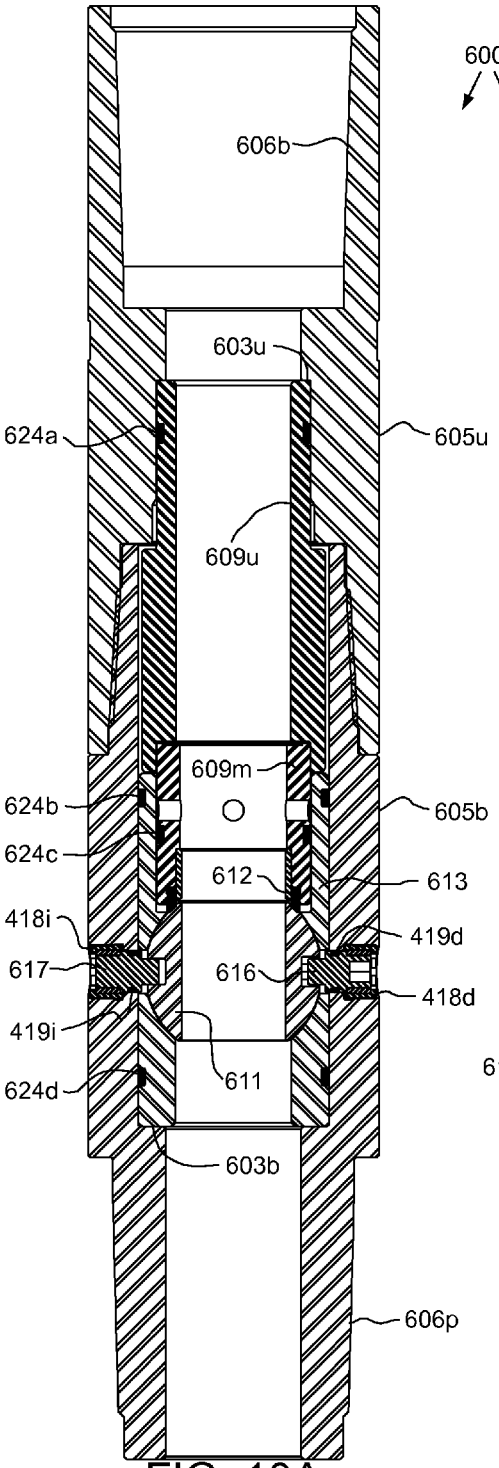
Figure 10B:
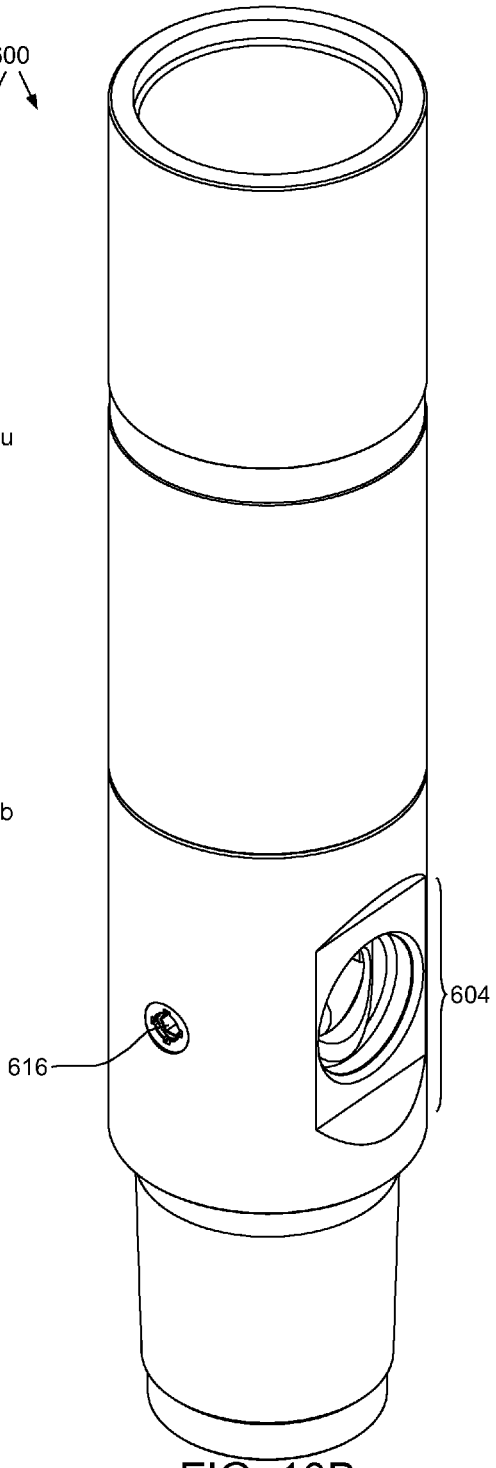
Figures 10C, 10D:
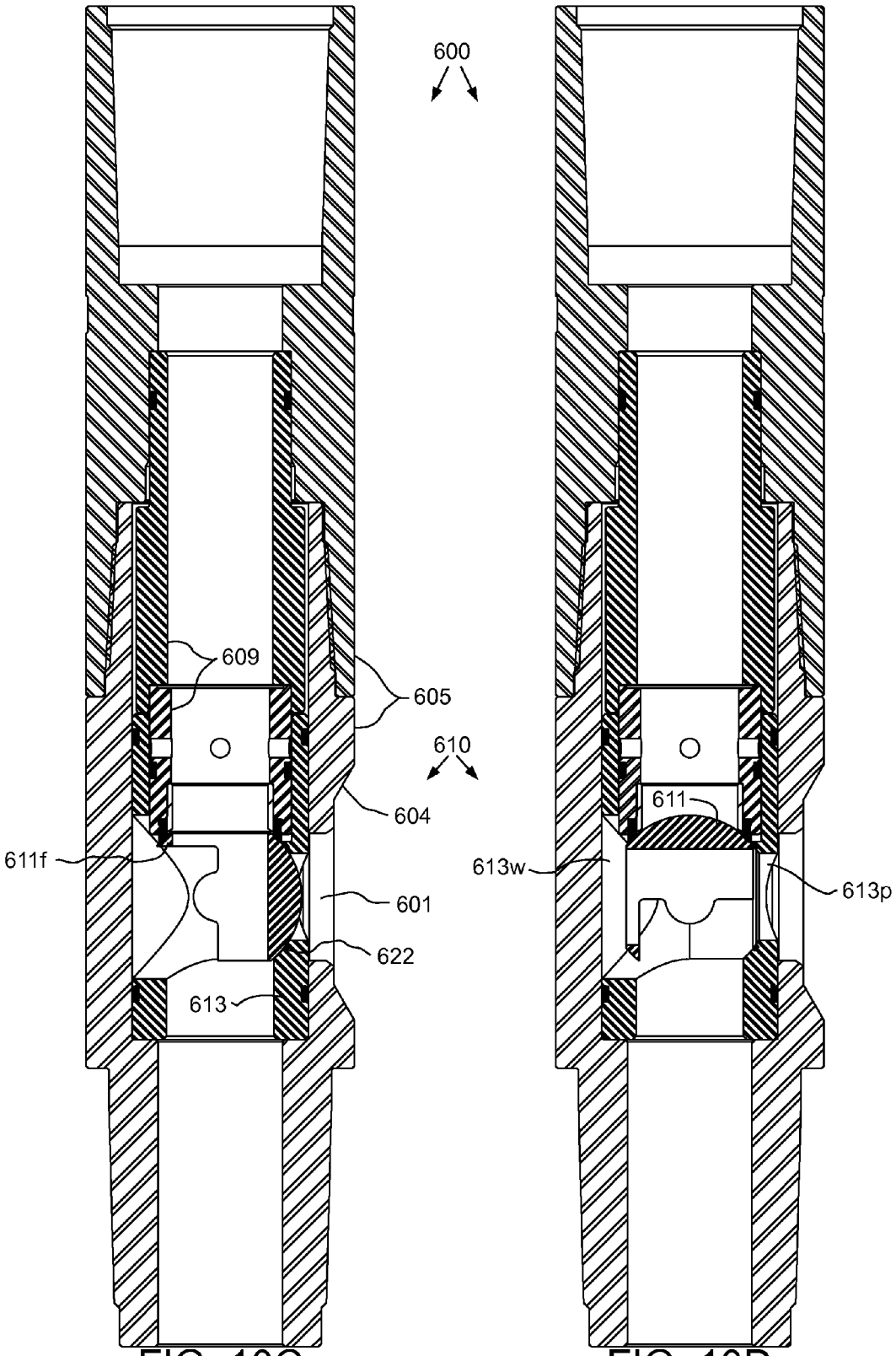

Referring specifically to FIG. 7D, upward movement of the sleeve 321 and cam 315 may continue, thereby fully closing the bore valve 310. The upward movement may be accommodated by sliding of the linkage/toggle pins 316 along the straight upper portions of the outer J-slots 313*j*. The upward movement may be halted by engagement of an upper shoulder of the yoke 213 with an upper shoulder of the stem portion 201*s* at which point the port valve 320 is fully open. The top drive 5 may then be operated to disconnect from the first alternative flow sub 300 and to hoist a stand from pipe rack 17. The top drive 5 may continue to be operated to connect to the first alternative flow sub 300 of the retrieved stand. The top drive 5 may then be operated to connect a lower end of the stand to the first alternative flow sub 300 of the drill string 10. Drilling fluid 60*d* may continue to be injected into the open port valve 320 during adding of the stand. Once the stand has been added to the drill string 10, the PLC 75 may pressurize the added stand 10*s* and then reverse operate the port valve actuator 210, thereby counter-rotating the lead screw 218 and lowering the yoke 213.

Referring specifically to FIG. 7E, lowering of the yoke 213 may cause downward movement of the valve sleeve 321 which may be free to move a short distance relative to the cam 315 due to the oversizing of the pin articulation portions of the inner J-slots 321*j*. The free movement may be halted by engagement of the tangential upper walls of the inner J-slots 321*j* with the linkage/toggle pins 316.

Referring specifically to FIG. 7F, downward movement of the valve sleeve 321 and cam 315 may commence opening of the bore valve 310. The downward movement may be accommodated by sliding of the linkage/toggle pins 316 along the straight upper portions of the outer J-slots 313*j*. The downward movement may be halted by engagement of the linkage/toggle pins 316 with the mid inclined portions of the outer J-slots 313*j*.

Referring specifically to FIG. 7G, continued downward movement of the valve sleeve 321 may drive the linkage/toggle pins 316 along the mid inclined portions of the outer J-slots 313*j*, thereby counter rotating the cam 315 about the longitudinal axis and moving the pins relative to the tangential upper walls of the inner J-slots 321*j*. Opening of the bore valve 310 may also continue.

Referring specifically to FIG. 7H, downward movement of the valve sleeve 321 and downward and rotational movement of the cam 315 may continue, thereby further opening the bore valve 310. The rotation of the cam 315 may be halted by engagement of the linkage/toggle pins 316 with the pin receiver portions of the outer J-slots 313*j* and this engagement may align the pins with the straight portions of the inner J-slots 321*j*.

Referring specifically to FIG. 7I, downward movement of the valve sleeve 321 and cam 315 may continue until a bottom of the cam 315 engages the top face of the lip 113*p* at which point the bore valve 310 may be fully open. Due to the lag, discussed above, drilling fluid 60*d* may momentarily flow into the drill string 10 through both the port valve 320 and the bore valve 310. The valve sleeve 321 may move then move downward relative to the cam 315 until tops of the inner J-slots 321*j* engage the linkage/toggle pins 316, at which point the port valve 320 is fully closed.

The PLC 75 may then relieve pressure from the clamp inlet 207. The rig crew may then return to the rig floor 4 and close the MSV 238. The clamp 200 may then be opened and transported away from the first alternative flow sub 300. The spider may then be operated to release the drill string 10. Once released, the top drive 5 may be operated to rotate 16 the drill string 10. Weight may be added to the drill bit 15, thereby advancing the drill string 10 into the wellbore 90 and resuming drilling of the wellbore. The process may be repeated until the wellbore 90 has been drilled to total depth or to a depth for setting another string of casing.

FIGS. 8A-8D illustrates a second alternative flow sub 400, according to another embodiment of the present disclosure. The second alternative flow sub 400 may include a tubular housing 405, a bore valve 410, a port valve actuator, and a side port valve 420. The housing 405 may include one or more sections, such as an upper section 405*u* and a lower 405*b* section, each section connected together, such as by a threaded connection. An outer diameter of the housing 405 may correspond to the tool joint diameter of the drill pipe 10*p* to maintain compatibility with the RCD 26. The housing 405 may have a central longitudinal bore formed therethrough and a radial flow port 401 formed through a wall thereof in fluid communication with the bore (when the port valve is open) and located at a side of the lower housing section 405*b*. Alternatively, the side port 401 may be inclined between the radial and longitudinal axes of the housing 405. The housing 405 may also have a threaded coupling at each longitudinal end, such as box 406*b* formed in an upper longitudinal end and a pin 406*p* formed on a lower longitudinal end, so that the housing may be assembled as part of the drill string 10. Except for seals and where otherwise specified, the second alternative flow sub 400 may be made from a metal or alloy, such as steel, stainless steel, or a nickel based alloy. Seals may be made from an elastomer or elastomeric copolymer and may include backup rings and/or energizing springs.

The upper housing section 405*u* may have an upper shoulder 403*u* formed in an inner surface thereof and adjacently below the box 406*b*. The lower housing section 405*b* may have a lower shoulder 403*b* formed in an inner surface thereof and adjacently below the side port 401. A length of the housing 405 may be equal to or less than the length of a standard joint of drill pipe 10*p*. Additionally, the housing 405 may be provided with one or more pup joints (not shown) in order to provide for a total assembly length equivalent to that of a standard joint of drill pipe 10*p*. The pup joints may include one or more centralizers (not shown) (aka stabilizers) or the centralizers may be mounted on the housing 405.

The bore valve 410 may include a closure member, such as a ball 411, a seat 412, and a body 409. The body 409 may be disposed within the housing 405 and include an upper section 409*u* and a lower section 409*b*. A first seal 424*a* may be disposed between the upper housing section 405*u* and the upper body section 409*u* and a second seal 424*b* may be disposed between the upper body section 409*u* and the lower body section 409*b* to isolate the interfaces thereof. The upper body section 409*u* may have a recess formed in an inner surface thereof and extending from a bottom thereof for receiving an upper portion of the lower body section 409*b*. The lower body section 409*b* may have one or more (three shown) equalization ports formed through a wall thereof adjacently above the second seal 424*b*.

The seat 412 may include a seal and a gland. The lower body section 409*b* may have a recess formed in an outer surface thereof and extending from a bottom thereof for receiving the seat 412. The seat seal may be coupled to the lower body section 409*b*, such as by a lip and by being disposed between the lower body section 409*b* and ball 411. The seat seal may be connected to the gland by being molded thereon and/or by a lip and groove. The seat seal may be annular and have a tapered inner surface conforming to an outer surface of the ball 411 for sealing engagement therewith. The seat seal may be pressed against the ball 411 by engagement of a top of the upper body section 409*u* with the upper housing shoulder 403*u* and engagement of a top of the lower body section 409*b* with a shoulder formed in an inner surface of the upper body section.

The ball 411 may be disposed in the housing 405 between the seat 412 and the port valve 420 and rotatable about a transverse axis of the housing 405. The ball 411 may be operable between an open position (FIG. 8A) and a closed position (FIG. 8B) by one or more pivot pins 416, 417. The ball 411 may have a bore formed therethrough corresponding to the housing bore and aligned therewith in the open position. A wall of the ball 411 may close an upper portion of the housing bore in the closed position and the ball may be engaged with the seat seal in and between the positions.

One of the pivot pins may be a drive pin 416 and the other may be an idler pin 417. Each pin 416, 417 may be received by a respective socket formed through a wall of the lower housing section 405*b*. Each pin 416, 417 may have a head portion and a shank portion. Each shank portion may be received by a respective socket 411*s* formed in an outer surface of the ball 411. Each shank portion and ball socket 411*s* may have a mating torsional profile, such as polygonal, formed in a mating surface thereof (outer surface for shank portion and inner surface for ball socket). The drive pin 416 may also have a torsional profile, such as polygonal, formed in an outer face thereof for receiving a drive shaft of the first alternative clamp. Each pin 416, 417 may be supported for rotation relative to the housing by a respective radial bearing 418*d,i*. Each bearing 418*d,i* may include an inner sleeve press fit onto a recess formed in an outer surface of the respective head portion and an outer sleeve connected to the respective housing socket, such as by a threaded connection. Each outer sleeve may have a lip formed in an inner surface thereof for trapping the respective pin in the respective housing socket. Each pin 416, 417 may have a groove formed in an outer surface of the respective head portion for receiving a respective seal 419*d,i*. Each seal 419*d,i* may engage a respective seal bore formed in the respective housing socket.

The port valve 420 may include a closure member, such as a sleeve 421, a port seal 422, and a pair of seals 424*c,d* disposed between the sleeve and the lower housing section 405*b* and straddling the side port 401 to isolate longitudinal interfaces thereof. The valve sleeve 421 may have a port 421*p* formed through a wall thereof corresponding to the side port 401 and a groove 421*v* formed in an outer surface thereof adjacent to the sleeve port. The port seal 422 may be disposed in the groove 421*v* and sealingly engage an inner surface of the lower housing section 405*b* to isolate a circumferential interface thereof. The valve sleeve 421 may be rotatable about a longitudinal axis of the housing 405 between an open position (FIG. 8B) and a closed position (FIG. 8A) by the port valve actuator. A wall of the valve sleeve 421 may close the side port 401 in the closed position and the sleeve port 421*p* may be aligned with the side port 401 in the open position. The valve sleeve 421 may be longitudinally retained in the housing 405 by being trapped between the ball 411 and the housing lower shoulder 403*b*. A recess 404 may be formed in an outer surface of the lower housing section 405*b* adjacent to the side port 401 for receiving a stab connector formed at an end of an inlet of a first alternative clamp (not shown).

The port valve actuator may be mechanical and include a pair of meshing gear profiles 411*g*, 421*g*. The ball 411 may have one of the gear profiles 411*g* formed in an outer surface thereof concentric with one of the sockets 411*s*. A flat 411*f* may be formed in an outer surface of the ball adjacent to the ball gear profile to accommodate meshing with the other gear profile 421*g* formed in a top of the valve sleeve 421. A flat 421*f* may be formed in the top of the valve sleeve 421 to accommodate the spherical outer surface of the ball 411 in mating of the gear profiles 411*g*, 421*g*. Each gear profile 411*g*, 421*g* may include a series of bevel teeth and the profiles may have orthogonal axes to convert the rotation of the ball 411 about the transverse axis into rotation about the longitudinal axis for operation of the valve sleeve 421. Each gear profile 411*g*, 421*g* may extend almost one hundred eighty degrees about the respective axis thereof. The gear profiles may have a ratio (ball/sleeve) of less than one such that for a quarter turn to move the ball between the positions, the valve sleeve 421 is rotated more than a quarter turn, such as one-third of a turn, to move the sleeve between the positions.

In operation, the first alternative clamp may be installed on the housing 405 in a similar fashion as the clamp 200 except that the first alternative clamp may have a drive shaft instead of the reciprocating yoke 213. The drive shaft may be stabbed into the drive pin profile during installation of the first alternative clamp. The PLC 75 may then operate the actuator motor 215 to rotate the drive shaft one quarter turn to shift the second alternative flow sub 400 from the top injection mode (FIG. 8A) to the bypass mode (FIG. 8B) and then operate the actuator motor 215 to counter rotate the drive shaft one-quarter turn to shift the second alternative flow sub back to the top injection mode. Alternatively, the second alternative flow sub 400 may be manually shifted between the modes.

FIGS. 9A-9D illustrates a third alternative flow sub 500, according to another embodiment of the present disclosure. The third alternative flow sub 500 may be similar to the second alternative flow sub 400 except the bore valve 510 has been decoupled from the port valve 520. The third alternative flow sub 500 may include a gear, such as a bevel gear 516, instead of having the gear profile 411*g* on the ball 511. The bevel gear 516 may mesh with gear profile 521*g* formed in a top of valve sleeve 521 and the valve sleeve top may have a flat 521*f* or the entire top may have the gear profile. A spacer sleeve 513 may accommodate inclusion of the gear 516. The third alternative flow sub 500 may further include a drive pin 516 similar to drive pin 416 for operation of the bevel gear 516, radial bearing 518, and seal 519.

In operation, a second alternative clamp (not shown) may be installed on housing 505 in a similar fashion as the first alternative clamp except that the second alternative clamp may have a second drive shaft in addition to the (first) drive shaft for independent operation of the port valve 510. The second drive shaft may be stabbed into the profile of the drive pin 516 during installation of the second alternative clamp. The PLC 75 may then operate a second actuator motor to rotate the second drive shaft before closing of the bore valve 510 when shifting from the top injection mode (FIG. 9A) to the bypass mode (FIG. 9B) and counter rotate the second drive shaft after opening of the bore valve when shifting back to the top injection mode to ensure that both valves 510, 520 are never closed simultaneously. Alternatively, the third alternative flow sub 500 may be manually shifted between the modes.

FIGS. 10A-10F illustrates a fourth alternative flow sub 600, according to another embodiment of the present disclosure. The fourth alternative flow sub 600 may include a tubular housing 605 and a combined bore and port valve 610. The housing 605 may include one or more sections, such as an upper section 605*u* and a lower 605*b* section, each section connected together, such as by a threaded connection. An outer diameter of the housing 605 may correspond to the tool joint diameter of the drill pipe 10*p* to maintain compatibility with the RCD 26. The housing 605 may have a central longitudinal bore formed therethrough and a radial flow port 601 formed through a wall thereof in fluid communication with the bore (when the port valve is open) and located at a side of the lower housing section 605*b*. Alternatively, the side port 601 may be inclined between the radial and longitudinal axes of the housing 605. The housing 605 may also have a threaded coupling at each longitudinal end, such as box 606*b* formed in an upper longitudinal end and a pin 606*p* formed on a lower longitudinal end, so that the housing may be assembled as part of the drill string 10. Except for seals and where otherwise specified, the fourth alternative flow sub 600 may be made from a metal or alloy, such as steel, stainless steel, or a nickel based alloy. Seals may be made from an elastomer or elastomeric copolymer and may include backup rings and/or energizing springs.

The upper housing section 605*u* may have an upper shoulder 603*u* formed in an inner surface thereof and adjacently below the box 606*b*. The lower housing section 605*b* may have a lower shoulder 603*b* formed in an inner surface thereof and adjacently below the side port 601. A recess 604 may be formed in an outer surface of the lower housing section 605*b* adjacent to the side port 601 for receiving a stab connector formed at an end of an inlet of a third alternative clamp (not shown). A length of the housing 605 may be equal to or less than the length of a standard joint of drill pipe 10*p*. Additionally, the housing 605 may be provided with one or more pup joints (not shown) in order to provide for a total assembly length equivalent to that of a standard joint of drill pipe 10*p*. The pup joints may include one or more centralizers (not shown) (aka stabilizers) or the centralizers may be mounted on the housing 605.

The combined bore and port valve 610 may include a closure member, such as a three-way ball 611, a seat 612, and a body 609. The body 609 may be disposed within the housing 605 and include an upper section 609*u*, a mid section 609*m*, and a lower cage 613. A first seal 624*a* may be disposed between the upper housing section 605*u* and the upper body section 609*u*, a second seal 624*b* may be disposed between the cage 613 and the lower body section 609*b* above the side port 601, a third seal may be disposed between the cage 613 and the mid body section 609*m*, and a fourth seal 624*d* may be disposed between the cage 613 and the lower body section 609*b* below the side port to isolate the interfaces thereof. The upper body section 609*u* may have a recess formed in an inner surface thereof and extending from a bottom thereof for receiving an upper portion of the mid body section 609*m*. The cage 613 may have a recess formed in an inner surface thereof and extending from a top thereof for receiving a lower portion of the mid body section 609*m*. The mid body section 609*m* may have one or more (three shown) equalization ports formed through a wall thereof adjacently above the third seal 624*c*.

The seat 612 may include a seal and a retainer. The mid body section 609*m* may have a recess formed in an inner surface thereof and extending from a bottom thereof for receiving the seat retainer. The seat seal may be coupled to the mid body section 609*m*, such as by a lip and groove. The seat seal may be connected to the retainer by being molded thereon and/or by a lip and groove. The seat seal may be annular and have a tapered inner surface conforming to an outer surface of the ball 611 for sealing engagement therewith. The seat seal may be pressed against the ball 611 by engagement of a top of the upper body section 609*u* with the upper housing shoulder 603*u* and engagement of a top of the mid body section 609*m* with a shoulder formed in an inner surface of the upper body section.

The three-way ball 611 may be disposed in the cage 613 via a window 613*w* formed through a wall thereof. The three-way ball 611 may be aligned with the side port 601. The three-way ball 611 may be rotatable relative to the cage 613 and the housing 605 about a transverse axis of the housing and between a top injection position (FIGS. 10A and 10C) and a bypass position (FIG. 10B) by pivot pins 616, 617. The three-way ball 611 may have a bore formed therethrough corresponding to the housing bore and aligned therewith in the top injection position while a wall thereof closes the side port 601. The three-way ball 611 may further have a side opening formed by carving nearly half the wall therefrom leaving only a seal flange 611*f* extending around the ball bore. In the bypass position, a wall of the three-way ball 611 may close an upper portion of the housing bore while the side opening may be aligned with the housing bore, thereby providing a flow path through the ball via the ball bore and the side opening. The seat seal may engage the seal flange 611*f* in the top injection position and the ball wall in the bypass position.

The cage 613 may have a port 613*p* formed through a wall thereof corresponding to the side port 601 and a groove 613*v* formed in an inner surface thereof adjacent to the sleeve port. A port seal 622 may be disposed in the groove 613*v* and sealingly engage the ball wall in the top injection position to isolate a circumferential interface thereof. The port 613*p* may be located at a side of the cage 613 opposite to the window 613*w*. The cage 613*h* may also have a pair of holes 613*h* formed through a wall thereof, located at opposite sides thereof, and spaced ninety degrees from the port 613*p* and window 613*w*.

Each pin 616, 617 may be received by a respective socket formed through a wall of the lower housing section 605*b*. Each pin 616, 617 may have a head portion and a shank portion. Each shank portion may extend through the respective hole 613*h* and be received by a respective socket 611*s* formed in an outer surface of the ball 611. Each shank portion and ball socket 611*s* may have a mating torsional profile, such as polygonal, formed in a mating surface thereof (outer surface for shank portion and inner surface for ball socket). The drive pin 616 may also have a torsional profile, such as polygonal, formed in an outer face thereof for receiving a drive shaft of the third alternative clamp. Each pin 616, 617 may be supported for rotation relative to the housing by the respective radial bearing 418*d,i*. Each pin 616, 617 may have a groove formed in an outer surface of the respective head portion for receiving the respective seal 419*d,i*. Extension of the pins 616, 617 through the holes 613*h* may also maintain alignment of the cage port 613*p* with the side port 601. A quarter turn/counter-turn of the drive pin 616 may rotate the three-way ball 611 between the positions.

In operation, the third alternative clamp may be installed on the housing 605 in a similar fashion as the clamp 200 except that the third alternative clamp may have a drive shaft instead of the reciprocating yoke 213. The drive shaft may be stabbed into the drive pin socket during installation of the first alternative clamp. The PLC 75 may then operate the actuator motor 215 to rotate the drive shaft one quarter turn to shift the fourth alternative flow sub 600 from the top injection mode to the bypass mode and then operate the actuator motor 215 to counter rotate the drive shaft one-quarter turn to shift the fourth alternative flow sub back to the top injection mode. Alternatively, the fourth alternative flow sub 600 may be manually shifted between the modes.

Figure 11A:
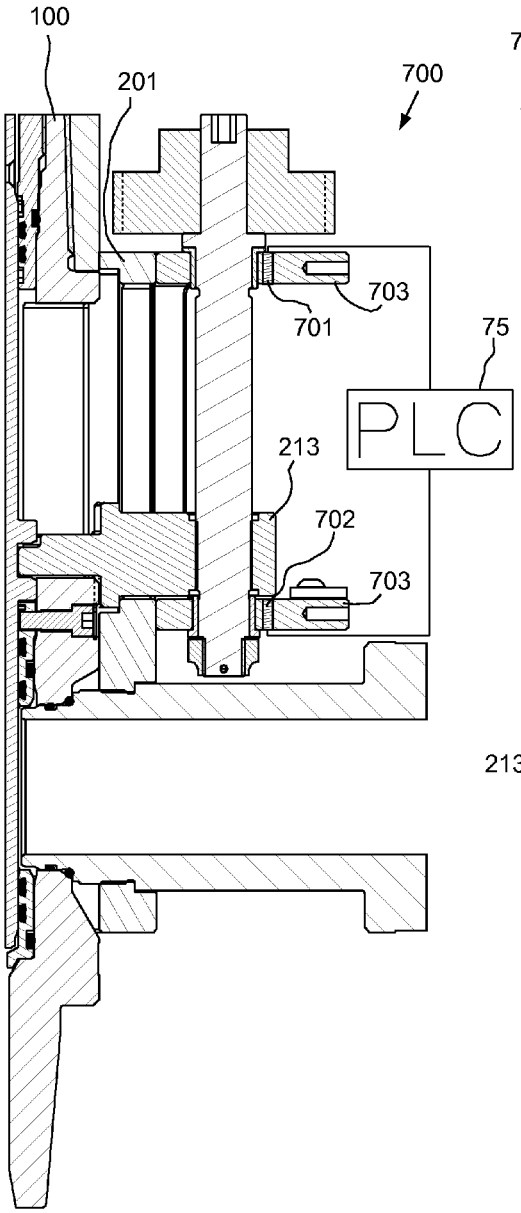
FIG. 11A illustrates a fourth alternative clamp, according to another embodiment of the present disclosure.

FIG. 11A illustrates a fourth alternative clamp 700, according to another embodiment of the present disclosure. The fourth alternative clamp 700 may be similar to the clamp 200 except for the addition of one or more proximity sensors 701, 702 to the port valve actuator. Although shown engaged with the flow sub 100, the fourth alternative clamp 700 may also be used with the first alternative flow sub 300. Each proximity sensor 701, 702 may be mounted in the bracket 703 at opposite ends thereof so as to be facing the path of the metallic yoke 213. The proximity sensors may be in electrical communication with the PLC 75 via a flexible electric cable to accommodate transport of the fourth alternative clamp 700.

Figure 11B:
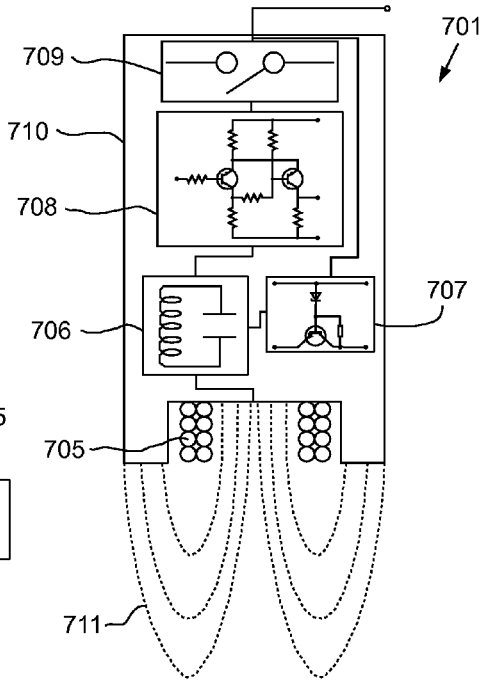
FIGS. 11B and 11C illustrate proximity sensors of the fourth alternative clamp.
Figure 11C:
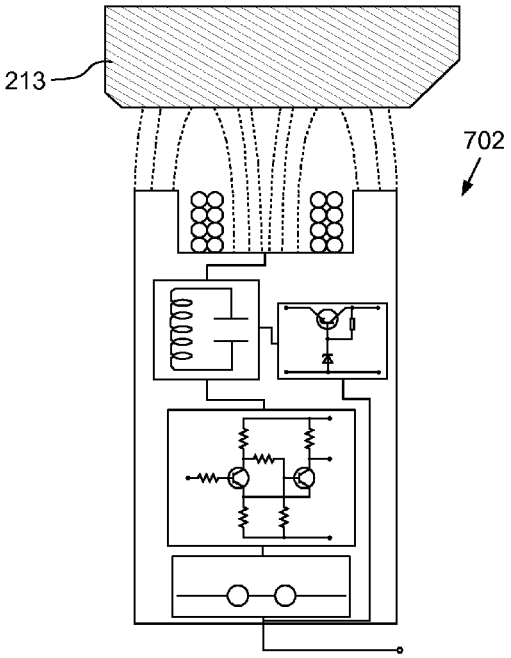

FIGS. 11B and 11C illustrate proximity sensors 701, 702 of the fourth alternative clamp 700. Each proximity sensor 701, 702 may be inductive and include a coil 705, an oscillator 706, a voltage regulator 707, a trigger 708, and a switch 709. Each oscillator 706, voltage regulator 707, trigger 708, and switch 709 may be enclosed in a respective housing 710 and each coil 705 may be wound in a recessed sensing face of the respective sensor 701, 702. Each coil 705, oscillator 706, voltage regulator 707, trigger 708, and switch 709 may be electrically interconnected, such as by leads or by being mounted onto a printed circuit board.

Once the fourth alternative clamp 700 has been engaged with and tightened around the flow sub 100, the PLC 75 may operate the proximity sensors 701, 702 to emit an electromagnetic field 711 into the path of the metallic yoke 213. As the metallic yoke 213 reaches the end of one of the strokes (downstroke shown), eddy currents may circulate therein. The eddy currents may cause a load on the respective oscillator 706, thereby decreasing the amplitude of the electromagnetic field 711 until the respective trigger 708 detects a lower threshold amplitude. Once the threshold amplitude is detected, the trigger 708 may throw the respective switch 709 which is detected by the PLC 75. As the metallic yoke 213 begins the upstroke, the respective trigger 708 may detect an increase in the amplitude of the electromagnetic field 711 and throw the respective switch 709 back to the default position once an upper threshold amplitude is detected.

Alternatively, the proximity sensors 701, 702 may instead be mounted in the body 201 at opposite ends thereof so as to be facing the path of the metallic yoke 213. Alternatively, each proximity sensor 701, 702 may include a separate transmitting and receiving coil instead of the respective transceiver coil 705. Alternatively, each proximity sensor 701, 702 may be Hall effect, ultrasonic, or optical or be a linear variable differential transformer (LVDT).

Figures 12A, 12B:
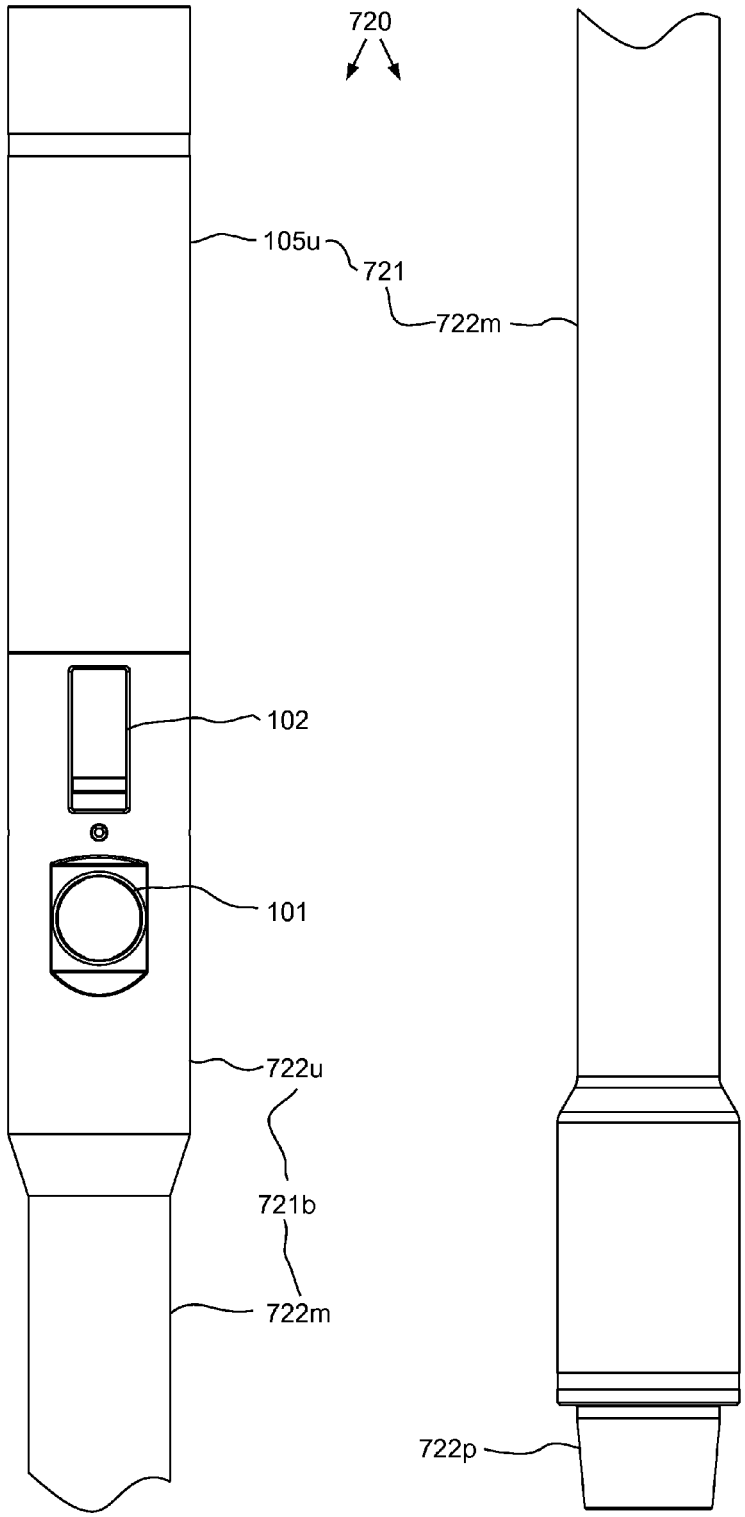
FIGS. 12A and 12B illustrate a fifth alternative flow sub, according to another embodiment of the present disclosure.

FIGS. 12A and 12B illustrate a fifth alternative flow sub 720, according to another embodiment of the present disclosure. The fifth alternative flow sub 720 may be similar to either the flow sub 100 or the first alternative flow sub 300 except for including an alternative housing 721. The alternative housing 721 may be tubular and include the upper section 105*u* and a lower 721*b* section, each section connected together, such as by a threaded connection. The alternative housing 721 may have a central longitudinal bore formed therethrough and the radial flow port 101 formed through a wall thereof in fluid communication with the bore (when the port valve is open) and located at a side of the lower housing section 721*b*. The window 102 may be formed through a wall of the lower housing section 721*b* and may extend a length corresponding to a stroke of the port valve 120.

The lower housing section 721*b* may have an upper portion 722*u*, a mid portion 722*m*, and a lower threaded coupling, such as a pin 722*p*, for assembly with the drill string 10. An outer diameter of the upper portion 722*u* and the pin 722*p* may correspond to the tool joint diameter of the drill pipe 10*p* and an outer diameter of the mid portion 722*m* may correspond to the nominal diameter of the drill pipe 10*p*. The lower housing section 721*b* may be manufactured by welding the upper portion 722*u* and the pin 722*p* to respective upset ends of the mid portion 722*m*. A length of the housing 721 may correspond to, such as being equal to or slightly greater than, the length of a standard joint of drill pipe 10*p*. To assemble a stand with fifth alternative flow sub 720, the fifth alternative flow sub may replace one of the joints of drill pipe 10*p*. As compared to forming the stand 10*s* using the flow sub 100, the threaded connection between the pin 106*p* and the upper joint of drill pipe 10*p* may be eliminated, thereby reducing the increase in length compared to a stand formed without the flow sub.

Figure 13A:
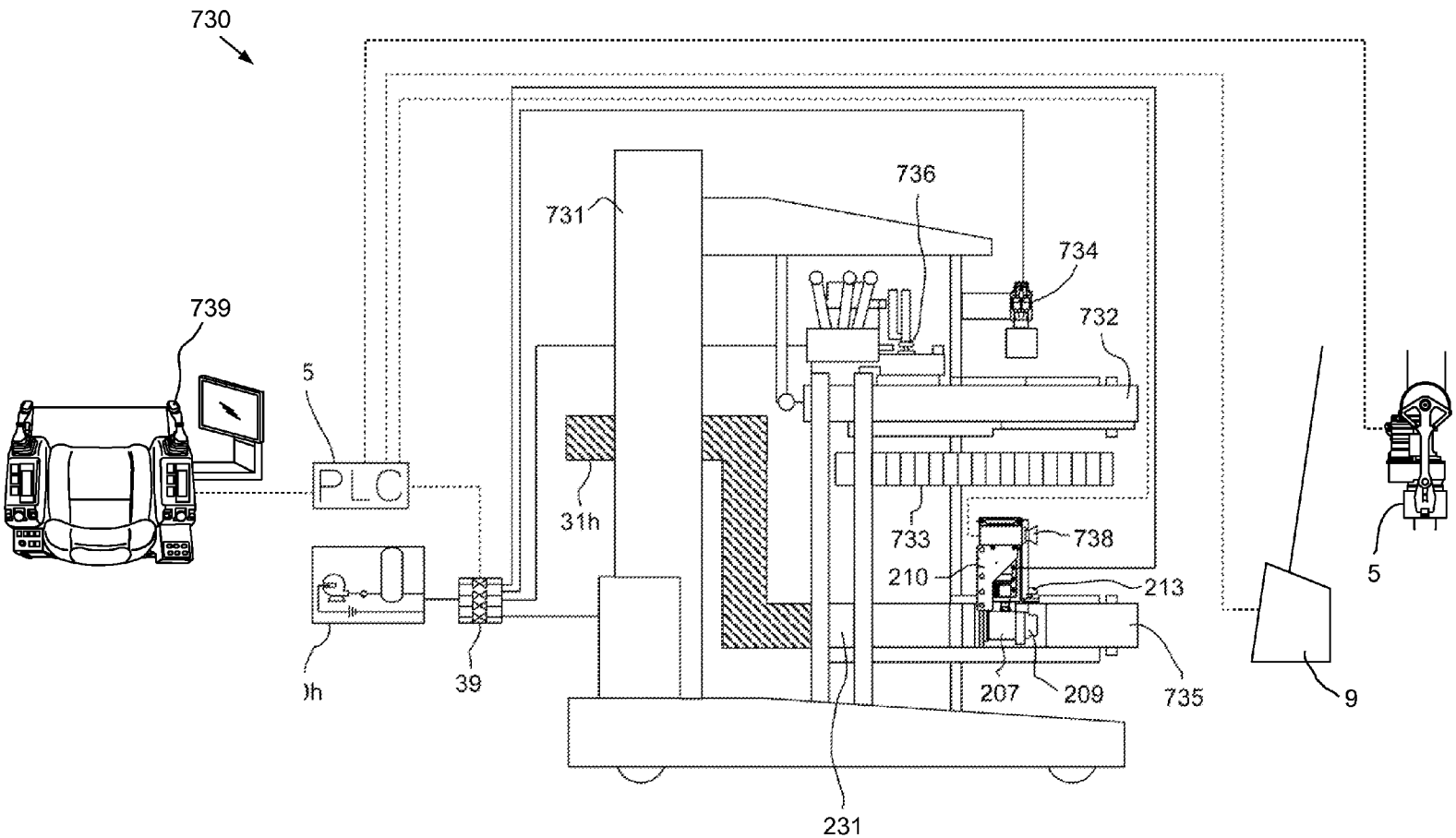
FIG. 13A illustrates an iron roughneck for use with the flow sub instead of the clamp, according to another embodiment of the present disclosure.

FIG. 13A illustrates an iron roughneck 730 for use with the flow sub 100 instead of the clamp 200, according to another embodiment of the present disclosure. The iron roughneck 730 may also be used with the first alternative flow sub 300 or the fifth alternative flow sub 720. The iron roughneck 730 may include a frame 731, a wrenching tong 732, a backup tong 733, a spinner 734, and a flow sub tong 735.

The wrenching tong 732 may be a disc with an opening (not shown) through the center thereof for receiving a bottom coupling of the stand 10*s* to be added to the drill string 10 and a recess cut from the edge to the opening at the center. The wrenching tong 732 may be provided with one or more, such as a pair, of pinion drives 736 arranged opposite each other at the periphery of the disc, equally spaced either side of the recess. Each pinion drive may include a drive motor, a drive shaft, and a pinion attached to the drive shaft.

The back-up tong 733 may be located beneath the wrenching tong 732. The back-up tong 733 may also be a disc with similar dimensions to the wrenching tong 732. The back-up tong may also have an opening through the center and a recess from the edge to the opening at the center for receiving the upper housing section 105*u*. The opening and recess may correspond to the opening and recess of the wrenching tong 732 when the back-up tong 733 and the wrenching tong are aligned.

A plurality of guide rollers or other guide elements may be spaced around the edge of the wrenching tong 732 in order to maintain the alignment of the wrenching tong with the back-up tong 733. A gear may be formed around the periphery of the back-up tong 733, broken by the recess thereof. The gear may mesh with the pinions attached to the drive motors on the wrenching tong 732, so that when the drive motors drive the drive shafts and gears, the wrenching tong rotates relative to the back-up tong 733.

The back-up tong 733 may have a plurality of roller bearings, upon which the wrenching tong 732 is placed. The roller bearings may be supported by a thread compensator in order to support the wrenching tong 732 during rotation thereof while accommodating longitudinal displacement of the stand 10*s* being added relative to the drill string 10 due to screwing together of the threaded couplings.

Each of the wrenching tong 732 and the back-up tong 733 may have one or more, such as three, clamping jaws (not shown) equipped with dies are located therein. The clamping jaws may be driven by the HPU 30*h* for engagement with the respective bottom coupling of the stand 10*s* and upper housing section 105*u*. The iron roughneck 730 may include a hub for receiving flexible hydraulic conduits from the manifold 39 and connecting the clamping jaws thereto. Each jaw may be driven by a piston and chamber assembly carried on the respective tong 732, 733. Each piston may have an end which is secured to the outside edge of the respective tong 732, 733. Each chamber may be connected to the respective jaw, such as by a spherical bearing.

The back-up tong 733 may be mounted to the frame 731. The spinner 734 may be mounted to the frame 731 above the tongs 732, 733 for rotating the bottom coupling of the stand 10*s* at high speed relative to a rotational speed of the tongs. The spinner may include a friction wheel driven by a motor and the motor may be in communication with the manifold 39 via the hub. The frame 731 may have wheels for rolling along rails of the rig floor 4 and one of the wheels may be driven by a motor in communication with the manifold via the hub.

The flow sub tong 735 may be mounted to the frame 731 beneath the back-up tong 733. The flow sub tong 735 may include a body, the inlet 207, the port valve actuator 210, an automated MSV (not shown), the adapter 231, a video monitoring unit 738, and one or more, such as two, clamping jaws. The body may also be a disc and have an opening through the center and a recess from the edge to the opening at the center for receiving the lower housing section 105*b*. The inlet 207 may be connected to the body and the port valve actuator 210 may be connected to the body. The clamping jaws may be disposed in the body and driven by the HPU 30*h* for engagement with the lower housing section 105*b* which may also pull the inlet 207 toward the lower housing section, thereby stabbing the stab connector 209 into the flow port 101 and engaging the yoke 213 with the lug 121*c*. Each jaw may be driven by a piston and chamber assembly carried on body. Each piston may have an end which is secured to the outside edge of the body. Each chamber may be connected to the respective jaw, such as by a spherical bearing.

The video monitoring unit 738 may have a video camera and a light source. The video monitoring unit 738 may be mounted on the port valve actuator 210 and be in data communication with the PLC 75, such as by a flexible cable. The PLC 75 may relay video to the driller's console 739 to facilitate alignment and orientation of the flow sub 100 with the iron roughneck 730. The driller's console 739 may be located in the rig control room remote from the rig floor 4 and/or be shielded from mud spray should the flow sub 100 fail.

Alternatively, the back-up tong 733, flow sub tong 735, and spinner 734 may be engaged with a track of the frame 731 and supported therefrom by a linear actuator to allow for vertical movement of the components relative to the frame. Alternatively, the tongs 732, 733, 735 and spinner 734 may be connected to a telescopic arm instead of the frame 731. The telescopic arm may be similar to the telescopic arm alternative discussed above. Alternatively, the hydraulic components of the iron roughneck 730 may instead be pneumatic or electric. Alternatively, the video monitoring unit 738 may be mounted on the body of the flow sub tong 735.

Figure 13B:
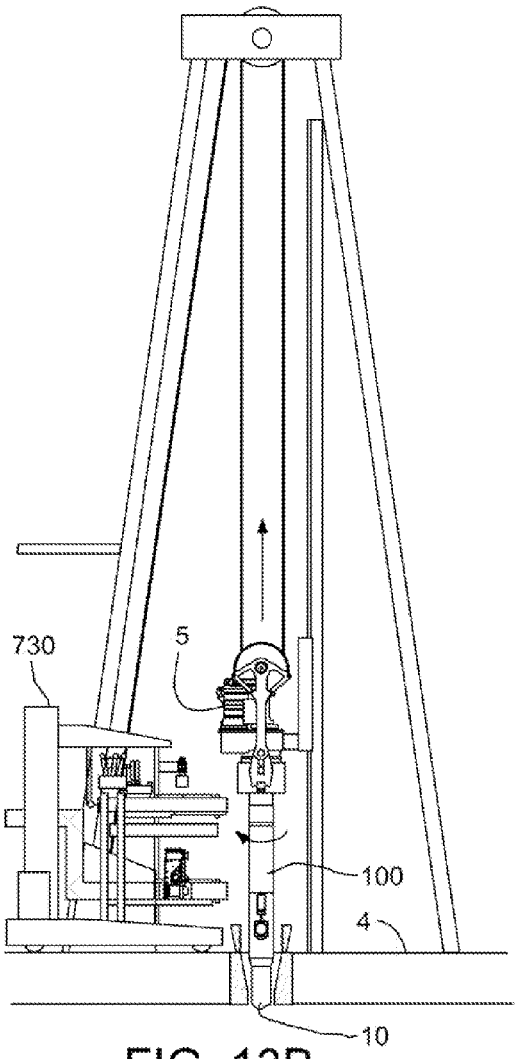
FIGS. 13B-13D illustrates engagement of the iron roughneck with the flow sub.
Figure 13C:
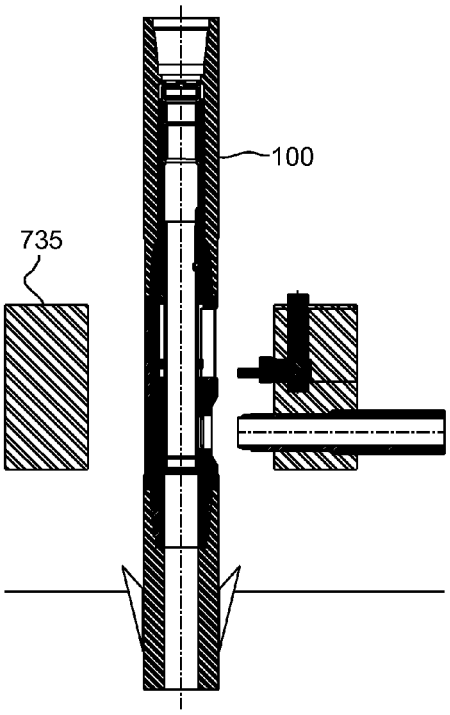
Figure 13D:
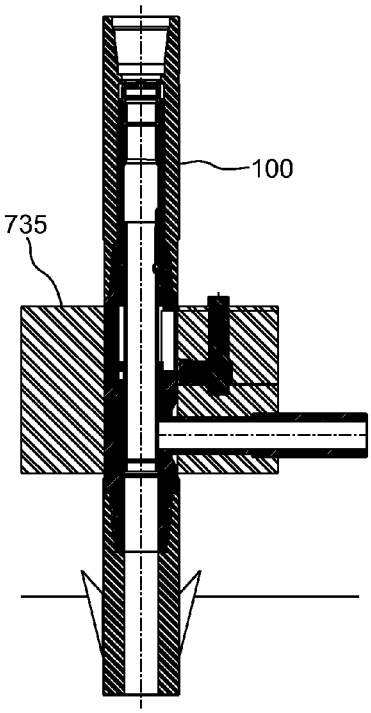

FIGS. 13B-13D illustrates engagement of the iron roughneck 730 with the flow sub 100. Once it is necessary to extend the drill string 10, drilling may be stopped by stopping advancement and rotation 16 of the top drive 5 and removing weight from the drill bit 15. The driller may operate the drive wheel motor of the iron roughneck 730, thereby propelling the iron roughneck from a stowed location on the rig floor 4 toward the drill string 10. The driller may stop the iron roughneck 730 at a location adjacent to the drill string 10 and activate the video monitoring unit 738. The driller may then operate the drawworks 9 to align the flow sub 100 with the iron roughneck 730 and operate the top drive 5 to orient the flow sub such that the flow port 101 and window 102 face the iron roughneck. The spider may then be operated to engage the drill string 10, thereby longitudinally supporting the drill string 10 from the rig floor 4. The rig crew may evacuate the rig floor 4. The driller may then operate the drive wheel motor such that the flow sub 100 is received into the recesses of the tongs 733, 735 and the clamping jaws of the back-up tong 733 and flow sub tong 735 may be engaged with the flow sub 100. Testing and switching of the flow to the flow sub 100 may proceed as discussed above.

Once the driller has operated the top drive 5 to hoist the stand 10*s* and operated the drawworks 9 to stab the bottom coupling thereof into the box 106*b*, the driller may operate the spinner 734 to screw the bottom coupling of the stand into the box. The driller may then operate the jaws of the wrenching tong 732 to engage the stand 10*s* and operate the drive motors of the iron roughneck 730 to tighten the connection between the stand 10*s* and the flow sub 100. Switching of the flow back to the top drive and testing may proceed as discussed above. The driller may then operate the iron roughneck 730 to release the flow sub 100 and the rig crew may return to the rig floor 4.

Figure 14A:
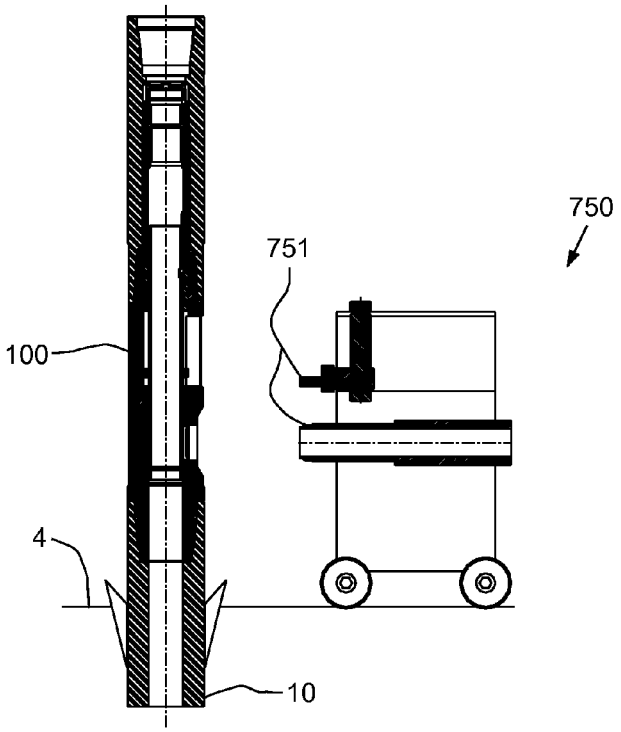
FIGS. 14A and 14B illustrate a rover for use with the flow sub instead of the clamp, according to another embodiment of the present disclosure.
Figure 14B:
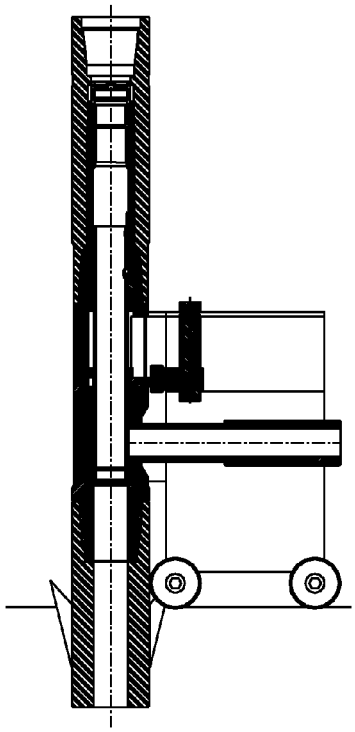

FIGS. 14A and 14B illustrate a rover 750 for use with the flow sub 100 instead of the clamp 200, according to another embodiment of the present disclosure. The rover 750 may also be used with the first alternative flow sub 300 or the fifth alternative flow sub 720. The rover 750 may include a chassis, a drive motor (not shown), wheels, a robotic arm (not shown), an automated clamp, the automated MSV (not shown), the adapter (not shown), the video monitoring unit (not shown), and one or more, such as two, clamping jaws (not shown). The rover 750 may be operated from the driller's console via data link with the PLC 75. The rover 750 may be electrically powered via battery or power cable.

The automated clamp 751 may be similar to the clamp 200 except for having automated jaws (not shown) instead of the band 202, the latch 205, and the band actuator 220. The automated jaws may be operated to engage the lower housing section 105*b* and to pull the inlet 207 toward the lower housing section, thereby stabbing the stab connector 209 into the flow port 101 and engaging the yoke 213 with the lug 121*c*. The automated clamp may be mounted to the robotic arm and the robotic arm may be mounted to the chassis. Instead of having to operate the drawworks and top drive to align and orient the iron roughneck 730 with the flow sub 100 before the spider is engaged, the spider may be engaged and the rover 750 may be driven across the rig floor 4 into the vicinity of the flow port 101 and window 102. The robotic arm may possess sufficient degrees of freedom, such as six, place the automated clamp around the lower housing section 105*b* and to align and orient the automated clamp 751 relative to the flow port 101 and window 102.

Alternatively, the robotic arm may be mounted to the rig floor 4 instead of to the chassis. Alternatively, the rover 750 may be autonomously driven by placing one or more beacons in the rig floor 4.

Figure 15A:
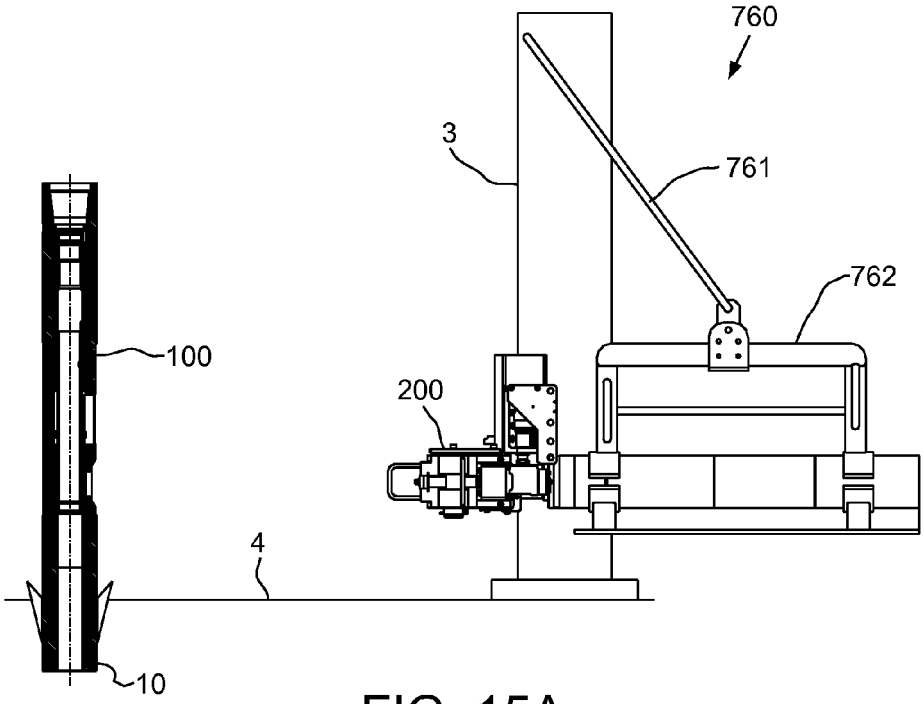
FIGS. 15A and 15B illustrate a handler for use with the clamp, according to another embodiment of the present disclosure.
Figure 15B:
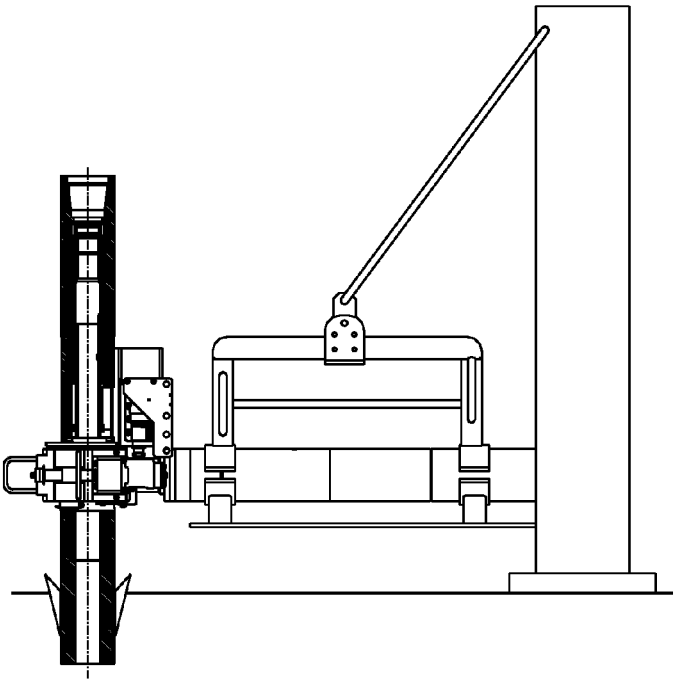

FIGS. 15A and 15B illustrate a handler 760 for use with the clamp 200, according to another embodiment of the present disclosure. The handler 760 may include an arm 761 pivotally connected to the derrick 3 and a harness 762 fastened to the clamp. The clamp 200 may be swung between a stowed position (FIG. 15A) and a ready position (FIG. 15B).

Alternatively, the handler 760 may be automated by adding a linear actuator and replacing the clamp 200 with the automated clamp 751. The linear actuator may be pivotally connected to the derrick 3 and the harness 762 and operable to swing the automated clamp 751 between the ready and stowed positions.

While the foregoing is directed to embodiments of the present disclosure, other and further embodiments of the disclosure may be devised without departing from the basic scope thereof, and the scope of the invention is determined by the claims that follow.

The invention claimed is:

1. A flow sub for use with a drill string, comprising:

a tubular housing having a longitudinal housing bore therethrough and a flow port through a wall thereof;

a ball disposed in the housing above the flow port, having a ball bore therethrough, and rotatable relative to the housing between an open position where the ball bore is aligned with the housing bore and a closed position where a wall of the ball blocks the housing bore;

a seat disposed in the housing above the ball for sealing against the ball wall in the closed position;

a sleeve disposed in the housing and movable between an open position where the flow port is exposed to the housing bore and a closed position where a wall of the sleeve is disposed between the flow port and the housing bore; and an actuator operably coupling the sleeve and the ball such that opening the sleeve closes the ball and closing the sleeve opens the ball, the actuator having a cam movable relative to the housing, operably connected to the ball, and releasably connected to the sleeve.

2. The flow sub of claim 1, wherein:

the sleeve is longitudinally movable relative to the housing, and the actuator is operable to close the ball after the sleeve is at least partially open and open the ball before the sleeve is fully closed.

3. The flow sub of claim 2, wherein the actuator comprises:

the cam longitudinally movable relative to the housing and having a cam socket formed through a wall of the cam;

a body disposed adjacently below the ball, connected to the housing, and having a linkage slot and a toggle slot, each slot formed through a wall of the body;

a groove formed in an inner surface of the housing;

a sleeve slot formed through a wall of the sleeve;

a sleeve socket formed through the sleeve wall;

a linkage pin fastened to the cam and extending through the linkage slot and into the sleeve slot; and a toggle pin extending through the cam socket and toggle slot and radially movable relative to the housing and the sleeve between a position engaged with the sleeve socket and a position disengaged from the sleeve socket by interaction with the housing groove.

4. The flow sub of claim 3, wherein:

the sleeve socket is aligned with a bottom of the sleeve slot, the linkage and toggle pins are aligned, and the linkage slot and toggle slot have equal widths and lengths.

5. The flow sub of claim 2, wherein the actuator comprises:

the cam longitudinally movable relative to the housing;

a body disposed adjacently below the ball, connected to the housing, and having a body j-slot through a wall of the body;

a sleeve j-slot formed through a wall of the sleeve; and a pin fastened to the cam and extending through the body j-slot and into the sleeve j-slot.

6. The flow sub of claim 5, wherein the sleeve j-slot has an upper tangential wall and a lower inclined wall forming an oversized portion to accommodate movement of the pin in an inclined portion of the body j-slot.

7. The flow sub of claim 5, wherein:

the ball is rotatable between the positions about a transverse axis of the housing, the cam and ball are rotatable about a longitudinal axis of the housing to accommodate movement of the pin along the j-slots.

8. The flow sub of claim 1, further comprising a piece of drill pipe connected to the housing and extending a length of the housing to correspond to a length of a joint of standard drill pipe.

9. The flow sub of claim 1, the actuator further comprising:

a body connected to the housing and having a slot formed through a wall of the body; and a slot formed through a wall of the sleeve.

10. The flow sub of claim 9, the actuator further comprising a pin fastened to the cam and extending through the slot of the body and into the slot of the sleeve.

11. The flow sub of claim 1, wherein the cam is rotatable about a longitudinal axis of the housing and longitudinally movable relative to the housing.

12. A continuous flow system, comprising:

a flow sub comprising:

a tubular housing having a longitudinal housing bore therethrough and a flow port through a wall thereof;

a ball disposed in the housing above the flow port, having a ball bore therethrough, and rotatable relative to the housing between an open position where the ball bore is aligned with the housing bore and a closed position where a wall of the ball blocks the housing bore;

a seat disposed in the housing above the ball for sealing against the ball wall in the closed position; and a sleeve disposed in the housing and movable between an open position where the flow port is exposed to the housing bore and a closed position where a wall of the sleeve is disposed between the flow port and the housing bore;

an inlet for injecting fluid into the flow port and operable to seal against a surface of the housing adjacent to the flow port; and an automated port valve actuator operable to move the sleeve, wherein:

the housing further has a window formed through the wall thereof and exposing an outer surface of the sleeve, and the port valve actuator engages the sleeve through the window as the inlet engages the housing.

13. The system of claim 12, wherein:

the sleeve has a lug formed in an outer surface thereof, the port valve actuator comprises:

a yoke for engaging the lug; and a pair of proximity sensors, each sensor facing a path of the yoke.

14. The system of claim 13, wherein:

the yoke is metallic, and the proximity sensors are each inductive.

15. The system of claim 13, wherein:

the yoke has a nut portion engaged with a lead screw, the port valve actuator further comprises:

a hydraulic motor; and a gear train operably coupling the lead screw to the hydraulic motor.

16. The system of claim 12, wherein:

the inlet and port valve actuator are connected to a body of a clamp, the clamp further comprises:

a band; and a latch operable to fasten the band to the body; and an automated band actuator operable to tension or loosen the band, body, and latch.

17. The system of claim 12, wherein:

the inlet and port valve actuator are connected to a body of a flow sub tong, and the flow sub tong is configured to engage the housing.

18. The system of claim 17, wherein:

the flow sub tong is mounted to a frame of an iron roughneck, and the iron roughneck further comprises:

a backup tong mounted to the frame;

a wrenching tong supported by the backup tong and rotatable relative thereto; and a spinner mounted to the frame.

19. The system of claim 12, wherein:

the inlet and port valve actuator are connected to a body of an automated clamp, and the automated clamp is configured to engage the housing, the automated clamp is carried on a chassis of a rover, and the rover further comprises a plurality of wheels and a drive motor.

20. The system of claim 12, wherein:

the inlet and port valve actuator are connected to a body of a clamp, and the clamp is suspended from a derrick of a drilling rig by a harness and an arm.

21. The system of claim 12, the flow sub further comprising an actuator operably coupling the sleeve and the ball such that opening the sleeve closes the ball and closing the sleeve opens the ball, the actuator having a cam movable relative to the housing, operably connected to the ball, and releasably connected to the sleeve.

22. The system of claim 21, the actuator of the flow sub further comprising:

a body connected to the housing and having a slot formed through a wall of the body; and a slot formed through a wall of the sleeve.

23. A method for drilling a wellbore, comprising:

drilling the wellbore by injecting drilling fluid into a top of a tubular string disposed in the wellbore at a first flow rate and rotating a drill bit, wherein:

the tubular string comprises:

the drill bit disposed at a bottom thereof, tubular joints connected together, and a flow sub disposed at a top thereof, wherein the flow sub comprises:

a tubular housing having a longitudinal housing bore therethrough and a flow port through a wall thereof;

a ball disposed in the housing above the flow port, having a ball bore therethrough, and rotatable relative to the housing between an open position where the ball bore is aligned with the housing bore and a closed position where a wall of the ball blocks the housing bore;

a seat disposed in the housing above the ball for sealing against the ball wall in the closed position;

a sleeve disposed in the housing and movable between an open position where the flow port is exposed to the housing bore and a closed position where a wall of the sleeve is disposed between the flow port and the housing bore; and an actuator operably coupling the sleeve and the ball such that opening the sleeve closes the ball and closing the sleeve opens the ball, the actuator having a cam movable relative to the housing, operably connected to the ball, and releasably connected to the sleeve, the drilling fluid exits the drill bit and carries cuttings from the drill bit, and the cuttings and drilling fluid (returns) flow from the drill bit via an annulus defined between the tubular string and the wellbore;

moving the sleeve to the open position; and injecting the drilling fluid into the flow port at a second flow rate while adding a stand to the tubular string, wherein injection of drilling fluid into the tubular string is continuously maintained between drilling and adding the stand to the tubular string.

24. The method of claim 23, wherein the flow sub automatically rotates the ball to the closed position in response to moving the sleeve to the open position.

25. The method of claim 23, further comprising rotating the ball to the closed position after moving the sleeve to the open position and before adding the stand.

26. The method of claim 23, the actuator of the flow sub further comprising:

a body connected to the housing and having a slot formed through a wall of the body; and a slot formed through a wall of the sleeve.

27. The method of claim 26, the actuator of the flow sub further comprising a pin fastened to the cam and extending through the slot of the body and into the slot of the sleeve.

28. The method of claim 23, wherein the cam is rotatable about a longitudinal axis of the housing and longitudinally movable relative to the housing.

* * * * *